US011598621B1

(12) United States Patent
Stowe et al.

(10) Patent No.: US 11,598,621 B1
(45) Date of Patent: Mar. 7, 2023

(54) MUNITIONS AND METHODS FOR OPERATING SAME

(71) Applicant: Corvid Technologies LLC, Mooresville, NC (US)

(72) Inventors: David Thomas Stowe, Mooresville, NC (US); Andrew John Auvil, Cornelius, NC (US)

(73) Assignee: Corvid Technologies LLC, Mooresville, NC (US)

( * ) Notice: Subject to any disclaimer, the term of this patent is extended or adjusted under 35 U.S.C. 154(b) by 0 days.

(21) Appl. No.: 17/729,406

(22) Filed: Apr. 26, 2022

Related U.S. Application Data

(63) Continuation of application No. 17/199,320, filed on Mar. 11, 2021, now Pat. No. 11,359,901, which is a (Continued)

(51) Int. Cl.
*F42D 5/045* (2006.01)
*F42B 12/20* (2006.01)
(Continued)

(52) U.S. Cl.
CPC ..... *F42D 5/045* (2013.01); *F42B 12/207* (2013.01); *F42B 12/28* (2013.01); *F42B 12/60* (2013.01)

(58) Field of Classification Search
CPC ..... F42B 12/22; F42B 12/207; F42B 12/28; F42B 12/60; F42D 5/045
See application file for complete search history.

(56) References Cited

U.S. PATENT DOCUMENTS 3,675,577 A 7/1972 Sternberg et al.
3,853,059 A 12/1974 Moe
(Continued)

*Primary Examiner* — Joshua E Freeman
(74) *Attorney, Agent, or Firm* — Myers Bigel, P.A.

(57) ABSTRACT

A munition includes a warhead having a warhead axis and axially opposed first and second warhead ends. The warhead includes: a tubular shock attenuation barrier including an axially extending passage extending from a first barrier end proximate the first warhead end to a second barrier end proximate the second warhead end; an explosive core charge disposed in the passage; an explosive main charge surrounding the shock attenuation barrier; projectiles surrounding the main charge; a core charge detonator; and a main charge detonator. The warhead is configured to be activated in each of a first projection mode and an alternative second projection mode. When the warhead is activated in the first projection mode, the main charge detonator detonates the main charge to thereby forcibly project the projectiles from the warhead with a first set of projection velocities and velocity profile. When the warhead is activated in the second projection mode, the core charge detonator detonates the core charge proximate the first barrier end such that a core charge detonation wave propagates through the passage to the second barrier end and, at the second barrier end, the core charge detonation wave detonates the main charge to thereby forcibly project the projectiles from the warhead with a second set of projection velocities and velocity profile. The second set of projectile velocities and velocity profile is different from the first set of projectile velocities and velocity profile.

21 Claims, 22 Drawing Sheets

Related U.S. Application Data continuation of application No. 16/456,081, filed on Jun. 28, 2019, now Pat. No. 10,982,942.

(60) Provisional application No. 62/732,752, filed on Sep. 18, 2018.

(51) Int. Cl.
*F42B 12/28* (2006.01)
*F42B 12/60* (2006.01)

(56) References Cited

U.S. PATENT DOCUMENTS 4,106,410 A 8/1978 Borcher et al.
4,106,411 A 8/1978 Borcher et al.
4,516,501 A 5/1985 Held et al.
4,655,139 A 4/1987 Wilhelm
4,658,727 A 4/1987 Wilhelm et al.
4,662,281 A 5/1987 Wilhelm et al.
5,544,589 A 8/1996 Held
6,174,587 B1 1/2001 Figge
7,066,093 B2 6/2006 Ronn et al.
7,347,906 B1 * 3/2008 Guirguis ..... F42B 12/50 102/389
7,845,282 B2 * 12/2010 Sheridan ..... F42B 12/207 102/497
8,250,986 B1 8/2012 Sheridan et al.
8,387,539 B1 3/2013 Maines
8,904,936 B2 12/2014 Treadway et al.
9,062,954 B2 6/2015 Treadway et al.
9,109,865 B2 8/2015 Haskins
9,683,822 B2 6/2017 Kerns et al.
9,784,541 B1 10/2017 Genson et al.
9,829,297 B2 11/2017 Graswald
2002/0166475 A1 11/2002 Brooks et al.
2004/0011238 A1 1/2004 Ronn et al.
2010/0282115 A1 11/2010 Sheridan et al.
2012/0227609 A1 9/2012 Volkmann
2013/0042782 A1 * 2/2013 Haskins ..... F42B 12/207 102/478
2014/0113086 A1 4/2014 Greenhill et al.
2016/0231096 A1 8/2016 Kerns et al.
2016/0370159 A1 12/2016 Bootes et al.
2017/0115108 A1 * 4/2017 Kerns ..... F16F 7/12

* cited by examiner

MUNITIONS AND METHODS FOR OPERATING SAME

RELATED APPLICATION

The present application is a continuation of and claims priority from U.S. patent application Ser. No. 17/199,320, filed Mar. 11, 2021, which is a continuation of and claims priority from U.S. patent application Ser. No. 16/456,081, now U.S. Pat. No. 10,982,942, filed Jun. 28, 2019, which claims the benefit of and priority from U.S. Provisional Patent Application No. 62/732,752, filed Sep. 18, 2018, the disclosures of which are incorporated herein by reference in their entirety.

STATEMENT OF GOVERNMENT SUPPORT

This invention was made with support under "Reactive Composite Materials for Asymmetric Shock Propagation in Multi-Functional Weapons" Contract No. FA8651-17-P-0114 awarded by Air Force Research Laboratory Munitions Directorate (AFRL/RWK). The Government has certain rights in the invention.

FIELD

The present invention relates to munitions and, more particularly, to munitions including projectiles.

BACKGROUND

Munitions such as bombs and missiles are used to inflict damage on targeted personnel and material. Some munitions of this type include a warhead including a plurality of projectiles and high explosive to project the projectiles at high velocity.

SUMMARY

According to some embodiments, a munition includes a warhead having a warhead axis and axially opposed first and second warhead ends. The warhead includes: a tubular shock attenuation barrier including an axially extending passage extending from a first barrier end proximate the first warhead end to a second barrier end proximate the second warhead end; an explosive core charge disposed in the passage; an explosive main charge surrounding the shock attenuation barrier; projectiles surrounding the main charge; a core charge detonator; and a main charge detonator. The warhead is configured to be activated in each of a first projection mode and an alternative second projection mode. When the warhead is activated in the first projection mode, the main charge detonator detonates the main charge to thereby forcibly project the projectiles from the warhead with a first set of projection velocities and velocity profile. When the warhead is activated in the second projection mode, the core charge detonator detonates the core charge proximate the first barrier end such that a core charge detonation wave propagates through the passage to the second barrier end and, at the second barrier end, the core charge detonation wave detonates the main charge to thereby forcibly project the projectiles from the warhead with a second set of projection velocities and velocity profile. The second set of projectile velocities and velocity profile is different from the first set of projectile velocities and velocity profile.

In some embodiments, when the warhead is activated in the second projection mode, the munition forcibly projects the projectiles from the warhead with reduced velocities as compared to the first projection mode.

According to some embodiments, when the warhead is activated in the second projection mode, the munition forcibly projects the projectiles with a different axial grading than when the munition projects the projectiles in the first projection mode.

In some embodiments, when the warhead is actuated in the first projection mode, a detonation wave from the main charge detonates the core charge.

In some embodiments, the main charge is tubular.

According to some embodiments, the shock attenuation barrier and the main charge are substantially concentric.

According to some embodiments, the munition includes an end member at the first barrier end. A port is defined in the end member. The main charge detonator includes a booster disposed in the port of the end member. When the warhead is activated in the second projection mode, explosion product gas from the detonation of the core charge escapes from the passage through the port.

In some embodiments, the shock attenuation barrier is formed of foam.

In some embodiments, the projectiles are disposed in contact with the main charge.

According to some embodiments, the projectiles are arranged in a substantially cylindrical array.

According to some embodiments, the passage terminates at a terminal opening at the second barrier end. The munition includes a transition volume proximate the terminal opening. The main charge includes a first charge section in the transition volume and a second charge section surrounding the shock attenuation barrier. When the warhead is activated in the second projection mode, the core charge detonation wave detonates the first charge section, and a detonation wave from the transition section thereafter detonates the second charge section.

In some embodiments, the passage has a substantially uniform inner diameter from the first barrier end to the second barrier end.

According to some embodiments, the passage has a non-uniform inner diameter.

According to some embodiments, the shock attenuation barrier has a conical outer diameter.

In some embodiments, the shock attenuation barrier has a tapered wall thickness.

In some embodiments, the shock attenuation barrier includes a plurality of transverse walls extending across and fully occluding the passage.

In some embodiments, the shock attenuation barrier includes a plurality of flanges projecting radially into and constricting the passage.

According to some embodiments, the passage has a diameter in the range of from about 5% to 70% of an outer diameter of the main charge.

According to some embodiments, the shock attenuation barrier has a length in the range of from about 90% to 99% of a length of the main charge.

The munition of claim 1 may be a missile.

The munition of claim 1 may be a bomb.

According to method embodiments, a method for operating a munition includes providing a munition including a warhead having a warhead axis and axially opposed first and second warhead ends. The warhead includes: a tubular shock attenuation barrier including an axially extending passage extending from a first barrier end proximate the first warhead end to a second barrier end proximate the second warhead end; an explosive core charge disposed in the passage; an explosive main charge surrounding the shock attenuation barrier; projectiles surrounding the main charge; a core charge detonator; and a main charge detonator. The warhead is configured to be activated in each of a first projection mode and an alternative second projection mode. The method further includes activating the warhead in either the first projection mode or the second projection mode. When the warhead is activated in the first projection mode, the main charge detonator detonates the main charge to thereby forcibly project the projectiles from the warhead with a first set of projection velocities and velocity profile. When the warhead is activated in the second projection mode, the core charge detonator detonates the core charge proximate the first barrier end such that a core charge detonation wave propagates through the passage to the second barrier end and, at the second barrier end, the core charge detonation wave detonates the main charge to thereby forcibly project the projectiles from the warhead with a second set of projection velocities and velocity profile. The second set of projectile velocities and velocity profile is different from the first set of projectile velocities and velocity profile.

According to further embodiments, a munition includes a warhead including: a shock attenuation barrier including a passage; an explosive core charge disposed in the passage; an explosive main charge on a side of the shock attenuation barrier opposite the core charge; projectiles surrounding the main charge; a core charge detonator; and a main charge detonator. The warhead is configured to be activated in each of a first projection mode and an alternative second projection mode. The warhead is activated in the first projection mode by detonating the main charge detonator to detonate the main charge, whereupon a main charge detonation wave from the main charge detonates the core charge, to thereby forcibly project the projectiles from the warhead with a first set of projection velocities and velocity profile. The warhead is activated in the second projection mode by: detonating the core charge detonator to detonate the core charge within the passage of the shock attenuation barrier, wherein the shock attenuation barrier attenuates a core charge detonation wave from the core charge to prevent the core charge detonation wave from detonating the main charge; and thereafter detonating the main charge detonator to detonate the main charge to thereby forcibly project the projectiles from the warhead with a second set of projection velocities and velocity profile. The second set of projectile velocities and velocity profile is different from the first set of projectile velocities and velocity profile.

In some embodiments, the warhead has a warhead axis and axially opposed first and second warhead ends. The shock attenuation barrier is tubular and the passage extends axially from a first barrier end proximate the first warhead end to a second barrier end proximate the second warhead end. The main charge surrounds the shock attenuation barrier. When the core charge detonator detonates the core charge, the core charge detonation wave propagates through the passage along the warhead axis.

According to some embodiments, the shock attenuation barrier includes a shock attenuation barrier wall that provides greater shock wave attenuation in a direction from the core charge to the main charge than in a direction from the main charge to the core charge, whereby the shock attenuation barrier: permits the main charge detonation wave to detonate the core charge in the first projection mode; and prevents the core charge detonation wave from detonating the main charge in the second projection mode.

According to further method embodiments, a method for operating a munition includes providing a munition including a warhead. The warhead includes: a shock attenuation barrier including a passage; an explosive core charge disposed in the passage; an explosive main charge on a side of the shock attenuation barrier opposite the core charge; projectiles surrounding the main charge; a core charge detonator; and a main charge detonator. The warhead is configured to be activated in each of a first projection mode and an alternative second projection mode. The method further includes activating the warhead in either the first projection mode or the second projection mode. When the warhead is activated in the first projection mode, the main charge detonator detonates the main charge, whereupon a main charge detonation wave from the main charge detonates the core charge, to thereby forcibly project the projectiles from the warhead with a first set of projection velocities and velocity profile. When the warhead is activated in the second projection mode: the core charge detonator is detonated to detonate the core charge within the passage of the shock attenuation barrier, wherein the shock attenuation barrier attenuates a core charge detonation wave from the core charge to prevent the core charge detonation wave from detonating the main charge; and thereafter the main charge detonator is detonated to detonate the main charge to thereby forcibly project the projectiles from the warhead with a second set of projection velocities and velocity profile. The second set of projectile velocities and velocity profile is different from the first set of projectile velocities and velocity profile.

According to further embodiments, a munition includes a first explosive charge, a second explosive charge, and an asymmetric shock attenuation barrier interposed between the first explosive charge and the second first explosive charge. The asymmetric shock attenuation barrier includes: a first barrier layer adjacent the first explosive charge; and a second barrier layer interposed between the first barrier layer and the second explosive charge. The first barrier layer has a first density, the second barrier layer has a second density, and the first density is greater than the second density. The munition is configured to be activated in each of a first activation mode and an alternative second activation mode. When the munition is activated in the first activation mode, the first explosive charge is detonated and generates a first detonation wave, and the asymmetric shock attenuation barrier attenuates the first detonation wave with a first attenuation profile that prevents the first detonation wave from detonating the second explosive charge. When the munition is activated in the second activation mode, the second explosive charge is detonated and generates a second detonation wave, and the asymmetric shock attenuation barrier attenuates the second detonation wave with a second attenuation profile that permits the second detonation wave to detonate the first explosive charge.

According to some embodiments, the first detonation wave has a first peak pressure incident on the second explosive charge; the second detonation wave has a second peak pressure incident on the first explosive charge; the first peak pressure is less than the second peak pressure; the first peak pressure is insufficient to detonate the second explosive charge; and the second peak pressure is sufficient to detonate the first explosive charge.

In some embodiments, the first detonation wave has a first peak pressure incident on the second explosive charge, and the asymmetric shock attenuation barrier spatially and temporally diffuses the first detonation wave to maintain the first peak pressure below a detonation threshold of the second explosive charge.

In some embodiments, a density of the first barrier layer is at least three times a density of the second barrier layer.

According to some embodiments, the density of the first barrier layer is in the range of from about 2 g/cc to 19.3 g/cc, and the density of the second barrier layer is in the range of from about 0.05 g/cc to 0.66 g/cc.

In some embodiments, the second barrier layer is porous.

In some embodiments, the second barrier layer includes gas-filled or evacuated voids.

According to some embodiments, the second barrier layer is a foam and/or a heterogeneous composite including components with gas-filled or evacuated voids.

In some embodiments, the first barrier layer has a first shock impedance (ZFU) when the first barrier layer is not loaded and is not compressed, and the second barrier layer has a second shock impedance (ZSU) when the second barrier layer is not loaded and is not compressed. The first shock impedance (ZFU) is at least six times the second shock impedance (ZSU).

According to some embodiments, the first barrier layer has a first shock impedance (ZFU) when the first barrier layer is not loaded and is not compressed. The second barrier layer has a second shock impedance (ZSU) when the second barrier layer is not loaded and is not compressed. The first barrier layer has a third shock impedance (ZFC) when the first barrier layer is fully loaded and compressed by the first detonation wave. The second barrier layer has a fourth shock impedance (ZSC) when the second barrier layer is fully loaded and compressed by the second detonation wave. The ratio of the third shock impedance (ZFC) to the fourth shock impedance (ZSC) is less than the ratio of the first shock impedance (ZFU) to the second shock impedance (ZSU).

In some embodiments, the third shock impedance (ZFC) is less than two times the fourth shock impedance (ZSC).

In some embodiments, the ratio of the first shock impedance (ZFU) to the second shock impedance (ZSU) is at least three times the ratio of the third shock impedance (ZFC) to the fourth shock impedance (ZSC).

In some embodiments, the first barrier layer includes a material selected from the group consisting of beryllium, aluminum, titanium, steel, molybdenum, tantalum, tungsten, and uranium.

According to some embodiments, the first barrier layer is formed of a material having a tensile spall strength of at least 100 MPa.

In some embodiments, the first barrier layer includes a first sublayer and a second sublayer interposed between the first sublayer and the second barrier layer, and the second sublayer has a tensile spall strength that is greater than the tensile spall strength of the first sublayer.

According to some embodiments, the first barrier layer is thicker than the second barrier layer.

In some embodiments, the first barrier layer contacts the first explosive charge and the second barrier layer, and the second barrier layer contacts the second explosive charge.

According to method embodiments, a method for operating a munition includes providing a munition including: a first explosive charge; a second explosive charge; and an asymmetric shock attenuation barrier interposed between the first explosive charge and the second first explosive charge. The asymmetric shock attenuation barrier includes: a first barrier layer adjacent the first explosive charge; and a second barrier layer interposed between the first barrier layer and the second explosive charge. The first barrier layer has a first density, the second barrier layer has a second density, and the first density is greater than the second density. The munition is configured to be activated in each of a first activation mode and an alternative second activation mode. The method further includes activating the munition in either the first activation mode or the second activation mode. When the munition is activated in the first activation mode, the first explosive charge is detonated and generates a first detonation wave, and the asymmetric shock attenuation barrier attenuates the first detonation wave with a first attenuation profile that prevents the first detonation wave from detonating the second explosive charge. When the munition is activated in the second activation mode, the second explosive charge is detonated and generates a second detonation wave, and the asymmetric shock attenuation barrier attenuates the second detonation wave with a second attenuation profile that permits the second detonation wave to detonate the first explosive charge.

BRIEF DESCRIPTION OF THE DRAWINGS

The accompanying figures are included to provide a further understanding of the present invention, and are incorporated in and constitute a part of this specification. The drawings illustrate some embodiments of the present invention and, together with the description, serve to explain principles of the present invention.

DESCRIPTION

Figure 2:
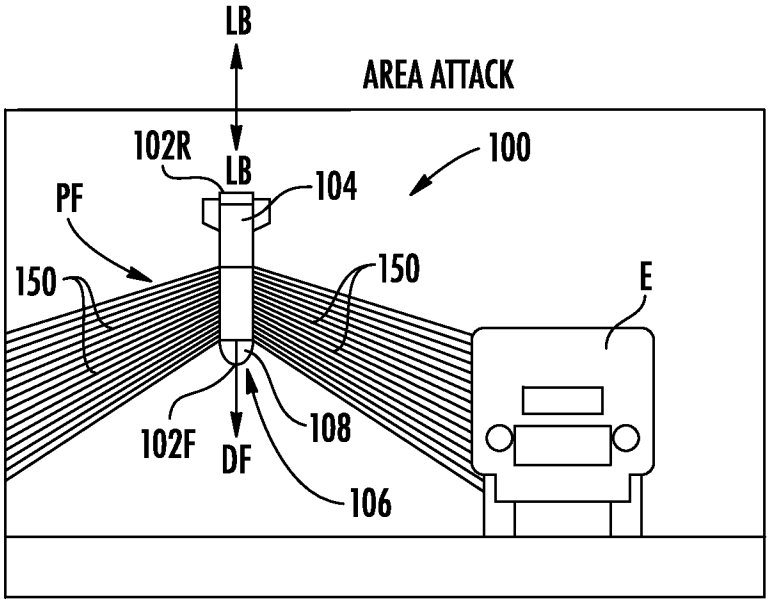
FIG. 2 is a schematic view of the munition of FIG. 1 being detonated in a controlled strike projection mode thereof

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As used herein, "monolithic" means an object that is a single, unitary piece formed or composed of a material without joints or seams.

The term "automatically" means that the operation is substantially, and may be entirely, carried out without human or manual input, and can be programmatically directed or carried out.

The term "programmatically" refers to operations directed and/or primarily carried out electronically by computer program modules, code and/or instructions.

The term "electronically" includes both wireless and wired connections between components.

In an explosive device, a shock wave (i.e., a discontinuity in density, pressure, and temperature which advances through a material with a velocity corresponding to the maximum pressure of the pulse) propagates from the explosion. Shock waves are characterized by a wave moving at a velocity higher than the sound speed in a given material. This is not to be confused with abrupt loading or impact that is often referred to as shock. The shock attentuation barriers of the invention therefore attenuate shock waves in solids, as opposed to shock waves in a gas, which are commonly referred to as blast waves.

Embodiments of the invention relate to munitions such as missiles and bombs intended for use against personnel and materiel. Specifically, the invention enables the selection of the projection energy of projectiles (e.g., preformed fragments) projected from a warhead. Projectile projection energy is a combination of weapon terminal velocity and warhead high explosive (HE) energy release.

The invention enables the selection of fragment velocities and velocity profiles of projectiles ejected radially from a warhead. A warhead according to embodiments of the invention provides selectable projectile yield modes, thereby enabling variable projection yield and variable effect.

Embodiments of the invention include a bimodal fragmenting warhead with variable fragment ejection velocities and velocity profiles. The warhead includes an internal, centrally located, cylindrical shock attenuation barrier loaded with a core charge consisting of high explosive (HE) material. There are two alternative projection modes. One of the projection modes uses a detonator (e.g., booster) located on one end of the warhead. The other projection mode uses a detonator (e.g., booster) located on an opposing end of the warhead. In the first mode of operation, the exploded warhead projects the projectiles at a first set of ejection velocities and velocity profile. In the second mode of operation, the exploded warhead projects the projectiles at a second set of ejection velocities and velocity profile, which are different from the first set. In some embodiments, the second mode is a controlled strike or focused projection mode wherein the warhead projects the projectiles at lower velocities as compared to the first mode, and with a velocity profile having an inverse velocity grade as compared to the first mode.

Munitions according to embodiments of the present invention are multi-modal. Like existing warheads and bombs, embodiments of the present invention provide for the capability of a wide area attack projection of projectiles (which may also be referred to herein as fragments) over a large area (standard or area attack mode). An additional capability of the munition is that the user can select that projectiles be projected with lower velocities (reduced, controlled strike or focused mode). In some embodiments, the change in lethality mode or projection mode is completely internal to the warhead, and requires no mechanical changes or modifications by the user prior to weapon launch.

In the area attack projection mode, the warhead may provide lethality on par with existing warheads.

Figure 3:
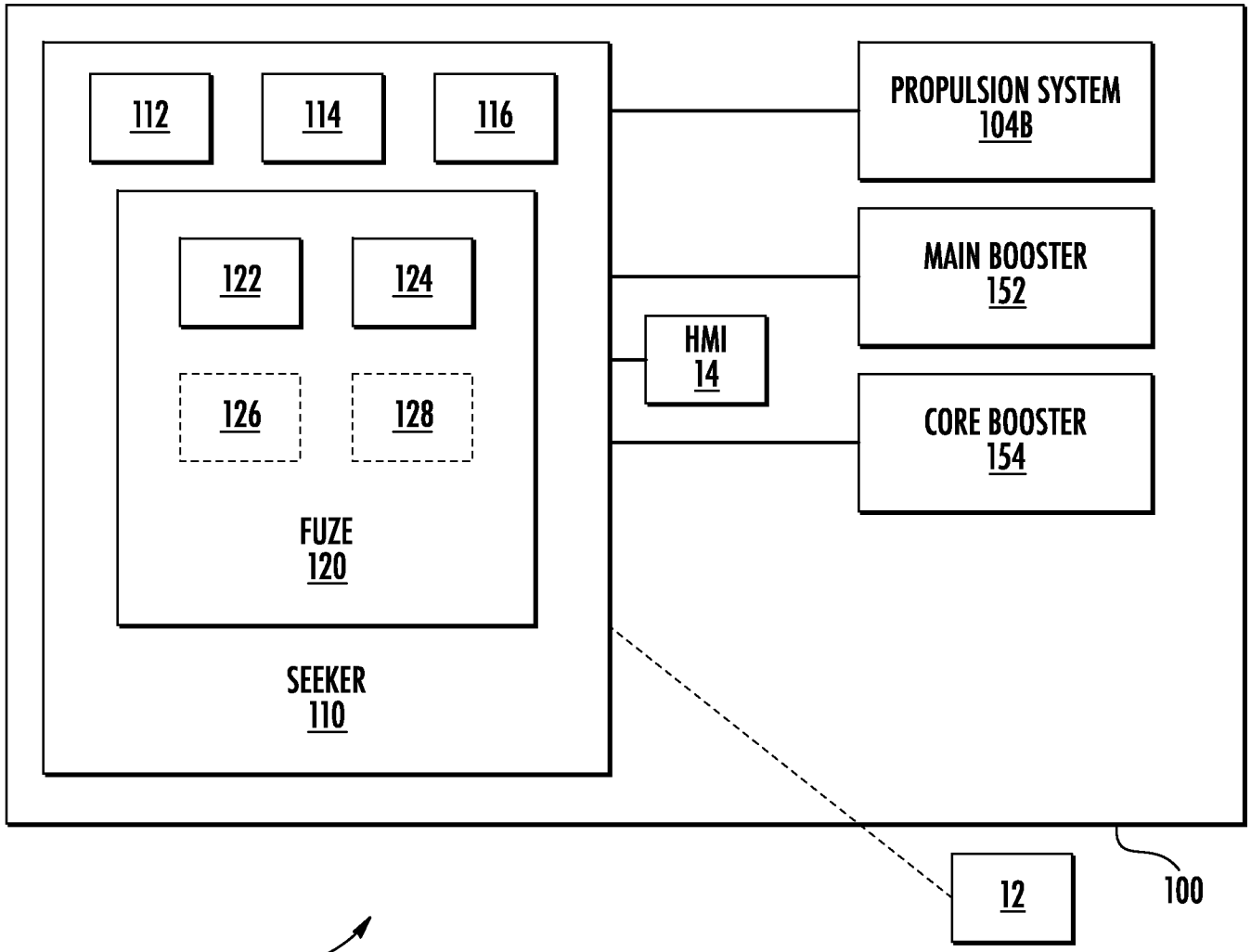
FIG. 3 is a schematic diagram representing a munition system including the munition of FIG. 1.

With reference to FIGS. 1-14, a munition system 10 according to embodiments of the invention is shown therein. The system 10 includes a munition 100 and, optionally, a remote controller 12 (FIG. 3). The system 10 may be used to apply a lethal or destructive force to a target E (FIGS. 1 and 2) using high energy projectiles 150 of the munition 100. The munition 100 includes an operational controller 122 and a warhead 140 including the projectiles 150. The projectiles 150 can be explosively projected from the munition 100 in the aforementioned different patterns by selectively activating either of two detonators 152, 154.

The illustrated munition 100 is a missile. However, embodiments of the invention may be used in other types of munitions, such as bombs (e.g., smart bombs). In use, the munition 100 travels generally in a direction of flight DF.

The munition 100 has a front end 102F and a rear end 102R. The munition 100 has a longitudinal or primary axis LB-LB. The munition 100 is configured to travel or fly in the forward direction DF along the longitudinal axis LB-LB. The munition 100 includes a front section 106 adjacent the front end 102F, and a rear section 104 adjacent the rear end 102R.

The rear section 104 serves as the propulsion section. The rear section 104 includes a housing or shell. A propulsion system 104B (FIG. 3) is housed in the housing. The rear section 104 may further include wings or other guidance components.

The front section 106 serves as the operational warhead section. The front section 106 includes a nose section 108 and a warhead 140. In the depicted embodiment, the warhead 140 is disposed directly behind the nose section 108, but other configurations are possible.

The nose section 108 includes a nose shell or cone fairing. A seeker subsystem 110 is housed within the nose fairing. The seeker subsystem 110 may include a guidance controller 112, a communications transceiver 114, a targeting detection device or system 116, and/or a fuze 120. The fuze 120 may include the operational controller 122 and a high voltage (HV) supply 124.

The operational controller 122 may be any suitable device or processor, such as a microprocessor-based computing device. While the operational controller 122 is described herein as being a part of the fuze 120, any suitable architectures or constructions may be used. For example, the functionality of the operational controller 122 may be distributed across or embodied in one or more controllers forming a part of the fuze 120, one or more controllers not forming a part of the fuze 120, or one or more controllers in the fuze 120 and one or more controllers not in the fuze 120.

The munition 100 or the warhead 140 may be provided with an input device or human-machine interface (HMI) 14. The HMI 14 and/or the remote controller 12 may be used by an operator to provide inputs (e.g., projection mode selection, settings, other commands) to the controller 122 and/or to report a status of the warhead 140 (e.g., display currently selected projection mode).

According to some embodiments, the fuze 120 is external of the warhead 140 (e.g., in the nose section 108 as described above). This may be advantageous in that is allows the warhead 140 to be used with existing or munition designs. However, in other embodiments, the fuze 120 can be integrated into the warhead 140. In some embodiments, the fuze 120 is controlled by an electronic safe-arm-fire device (ESAF) onboard the munition 100.

The warhead 140 has a warhead longitudinal axis L-L and has a front end 142F and a rear end 142R spaced apart along the longitudinal axis L-L. The longitudinal axis L-L may be substantially parallel with the longitudinal axis LB-LB of the missile 100. The warhead 140 also has transverse or radial axes R-R (FIGS. 6 and 8) that extend perpendicular to the longitudinal axis L-L.

The warhead 140 includes a front end plate, member or cap 144, a rear end plate, member or cap 146, a primary or main charge detonator 152, a secondary or core charge detonator 154, a primary or main charge 156, a secondary or core charge 158, a plurality of projectiles 150, and a shock attenuation liner or barrier 160.

The end cap 144 includes a centrally located seat or port 144A. The end cap 146 includes a centrally located seat or port 146A.

The main charge and core charge detonators 152, 154 may each be explosive boosters. The core charge booster 154 is seated in the port 144A. The main charge booster 152 is seated in the port 146A.

The projectiles 150 are configured in a tubular, hollow cylindrical array 151. The array 151 has a central longitudinal axis LA-LA that may be substantially concentric or coaxial with the axis L-L. The open ends 151A of the array 151 are covered by the end caps 144, 146. The array 151 and the end caps 144, 146 collectively form an interior region, volume or cavity 148.

The main charge 156, the core charge 158, and the shock attenuation barrier 160 are disposed in the cavity 148. The array 151 of projectiles 150 surrounds the main charge 156. In some embodiments, the projectiles 150 are mounted directly on (in contact with) the radially outwardly facing surface 156A of the main charge 156. A cover or covers may be provided over the projectiles 150.

In some embodiments, the outer surface 156A of the main charge 156 is substantially cylindrical and concentric with the axis L-L.

In some embodiments, the cavity 148 is substantially entirely filled by the main charge 156, the core charge 158, and the shock attenuation barrier 160.

The shock attenuation barrier 160 is a tubular member including a wall 161 and having a longitudinal axis LS-LS, a front barrier end 162F, and a rear barrier end 162R. The shock attenuation barrier 160 includes a longitudinally extending core cavity or passage 164 (defined by an inner surface 163A), a front end opening 166F, and an opposing rear end opening 166R. The end openings 166F, 166R are located at the opposed terminal ends of the core passage 164. Each end opening 166F, 166R is in fluid communication with or contiguous with the core passage 164.

In some embodiments, the inner surface 163A of the shock attenuation barrier (defining the passage 164) is substantially cylindrical. In some embodiments, an outer surface 163B of the shock attenuation barrier 160 is substantially cylindrical. In some embodiments and as shown, the passage 164 and the outer diameter of the shock attenuation barrier 160 are substantially circular in cross-section. In some embodiments and as shown, the inner diameter of the passage 164 is substantially uniform from end 162F to end 162R.

In some embodiments, the longitudinal axis LS-LS is substantially concentric with the axis L-L.

The front end 162F is located at the end cap 144. In some embodiments, the front end 162F is fitted into or connected to the end cap 144 such that the end opening 166F is sealed with the end cap 144.

Figure 8:
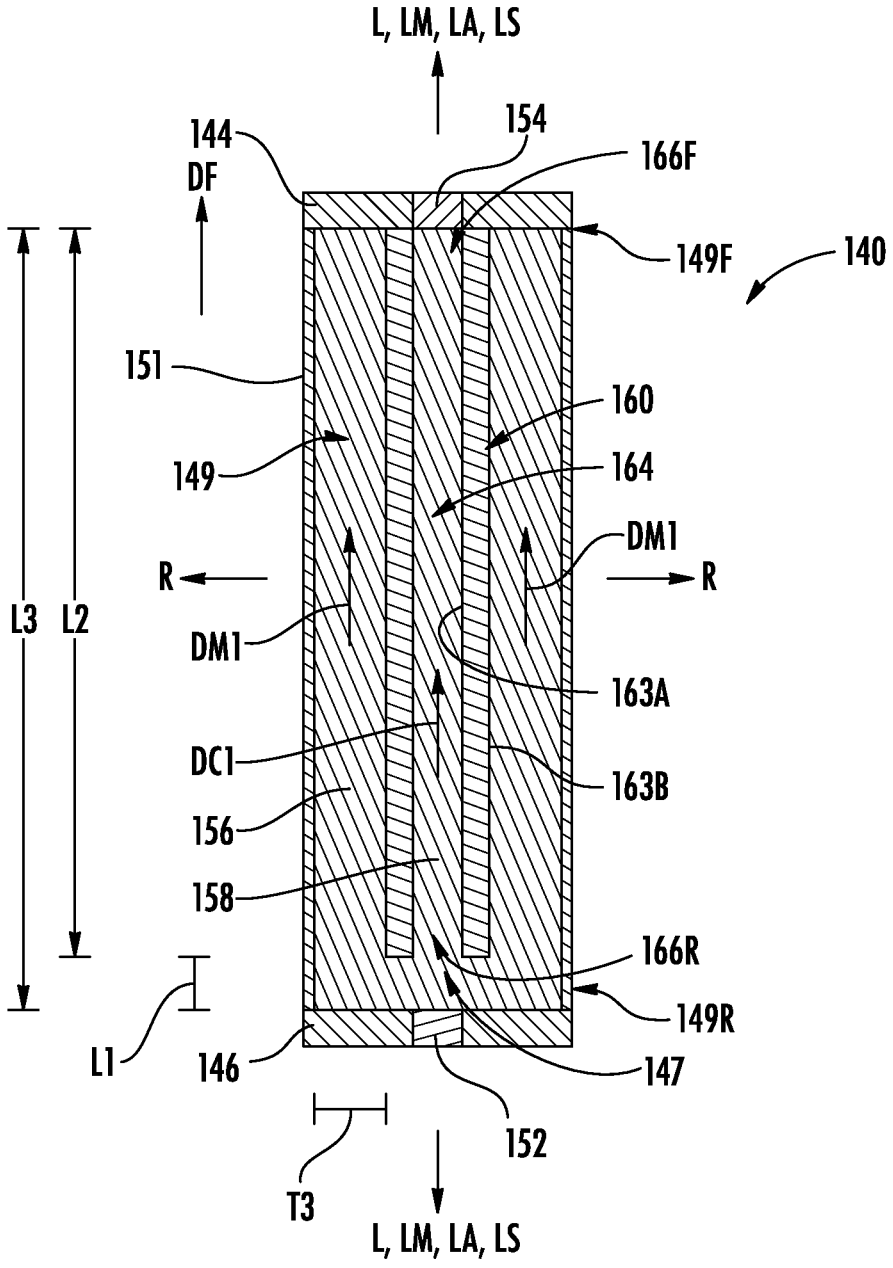
FIG. 8 is a cross-sectional view of the warhead of FIG. 4 illustrating operation of the warhead in an area attack mode.

The rear end 162R of the shock attenuation barrier 160 is located proximate the rear end cap 146, but is axially spaced apart from the end cap 146 a distance L1 (FIG. 8). In some embodiments, the distance L1 is in the range of from about 1% to 10% of the length L3 (FIG. 8) of the main charge 156.

In some embodiments, the axial length L2 (FIG. 8) of the shock attenuation barrier 160 is in the range of from about 90% to 99% of the length L3 (FIG. 8) of the main charge 156.

In some embodiments, the inner diameter D2 (FIG. 7) of the passage 164 is in the range of from about 5% to 70% of the outer diameter D9 (FIG. 6) of the main charge 156.

In some embodiments, the shock attenuation barrier 160 has a radial thickness T2 (FIG. 7; extending from the inner diameter of the shock attenuation barrier 160 to the outer diameter of the shock attenuation barrier 160) in the range of from about 10% to 50% of the diameter D2.

The core charge 158 is disposed in the passage 164. In some embodiments, the core charge 158 substantially fills the passage 164 from end 162F to end 162R.

The outer surface 163B of the shock attenuation barrier 160 and the inner surface of the projectile array 151 define an outer cavity 149 therebetween. The main cavity 149 is tubular and hollow cylindrical. The main cavity 149 defines a longitudinal axis LM-LM and extends from a rear end 149R to a front end 149F. In some embodiments, the longitudinal axis LM-LM is substantially concentric with the axis L-L.

In some embodiments, the main cavity 149 has a radial thickness T3 (FIG. 8) (FIG. 7; extending from the inner diameter of the main charge 156 to the outer diameter of the main charge 156) in the range of from about 5% to 45% of the outer diameter D9.

In some embodiments, the axial length L3 (FIG. 8) of the main charge 156 is in the range of from about 10 inches to 10 feet.

Additionally, a transition volume or cavity 147 is defined axially between the rear end 162R and the rear end cap 146. The transition cavity 147 is contiguous with both the opening 166R and the main cavity 149.

A first charge section of the main charge 156 is disposed in the main cavity 149. A second charge section of the main charge 156 is disposed in and the transition cavity 147. In some embodiments, the main charge 156 fully circumferentially surrounds the shock attenuation barrier 160. In some embodiments, the main charge 156 substantially fills the main cavity 149 and the transition cavity 147 from end 149R to end 149F.

Figure 4:
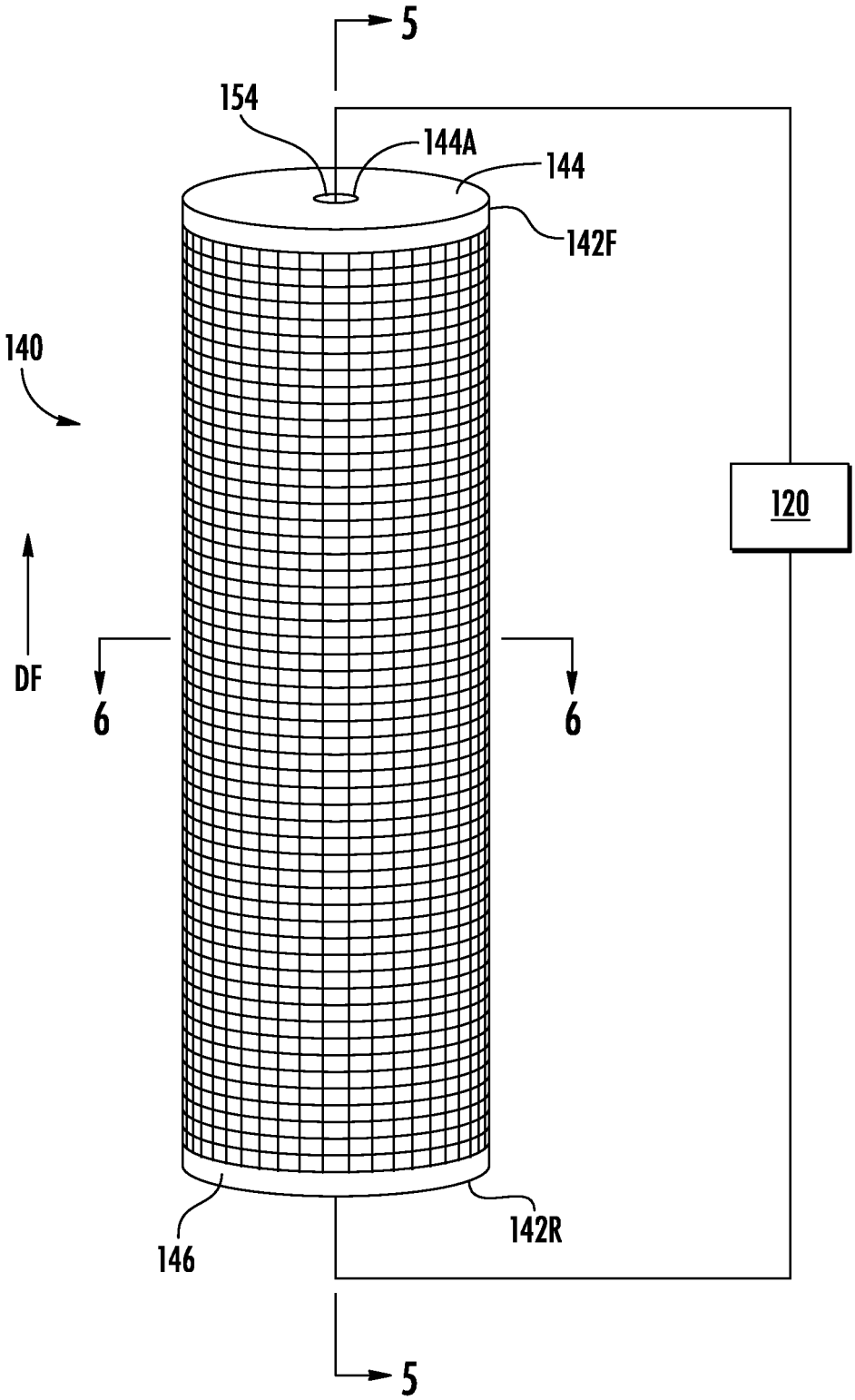
FIG. 4 is a perspective view of a warhead forming a part of the munition of FIG. 1.
Figure 5:
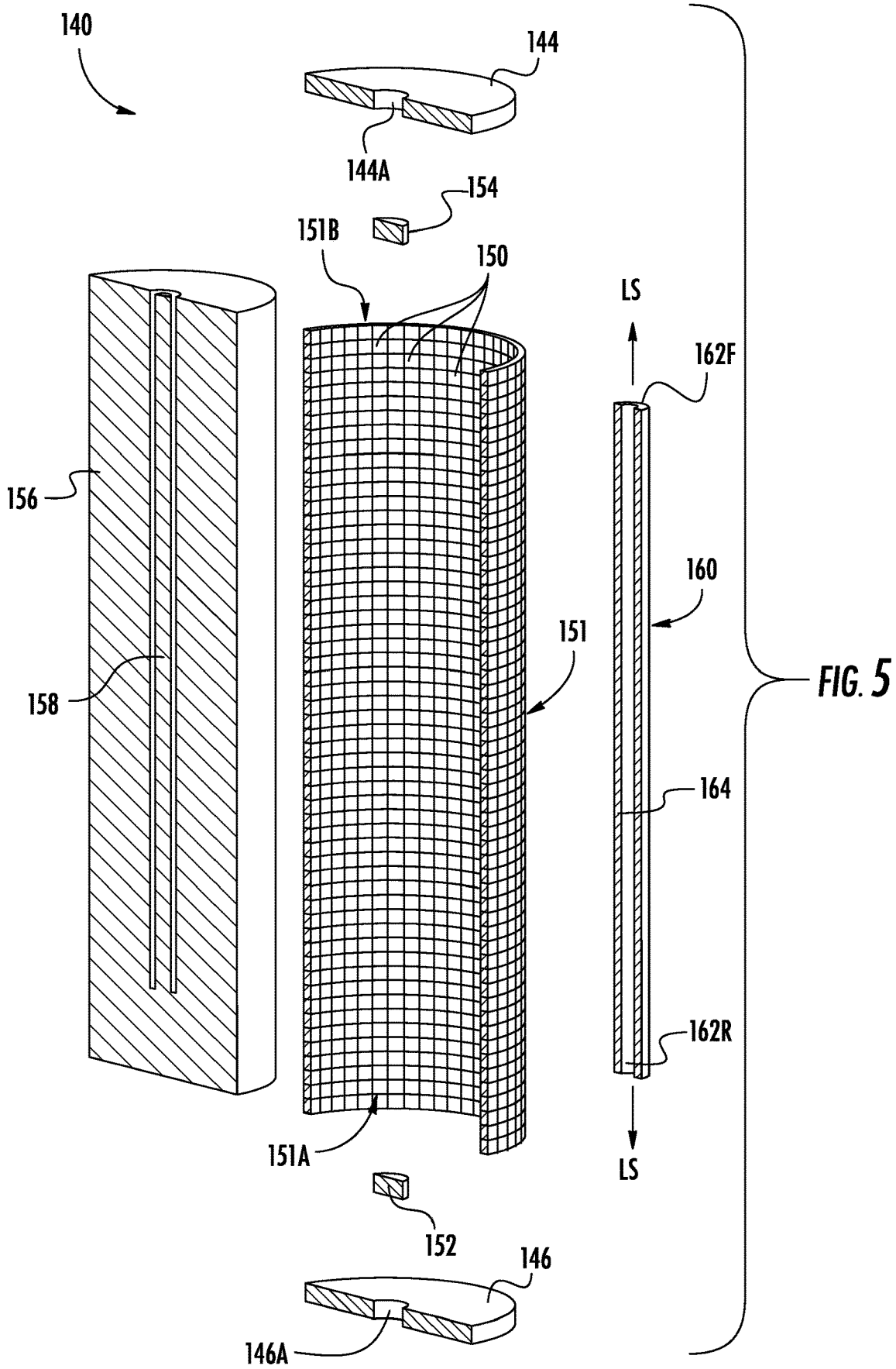
FIG. 5 is a cross-sectional view of the munition of FIG. 1 taken along the line 5-5 of FIG. 4.
Figure 6:
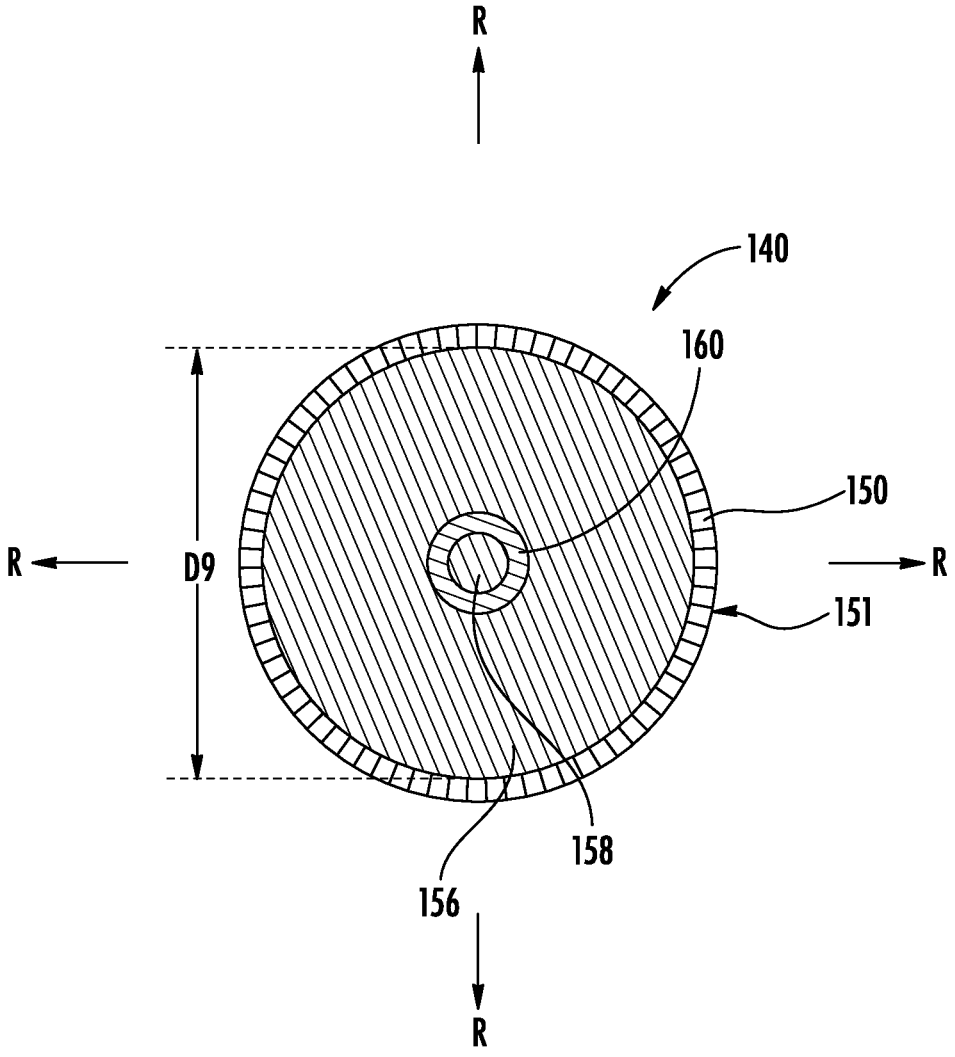
FIG. 6 is a cross-sectional view of the munition of FIG. 1 taken along the line 6-6 of FIG. 4.
Figure 7:
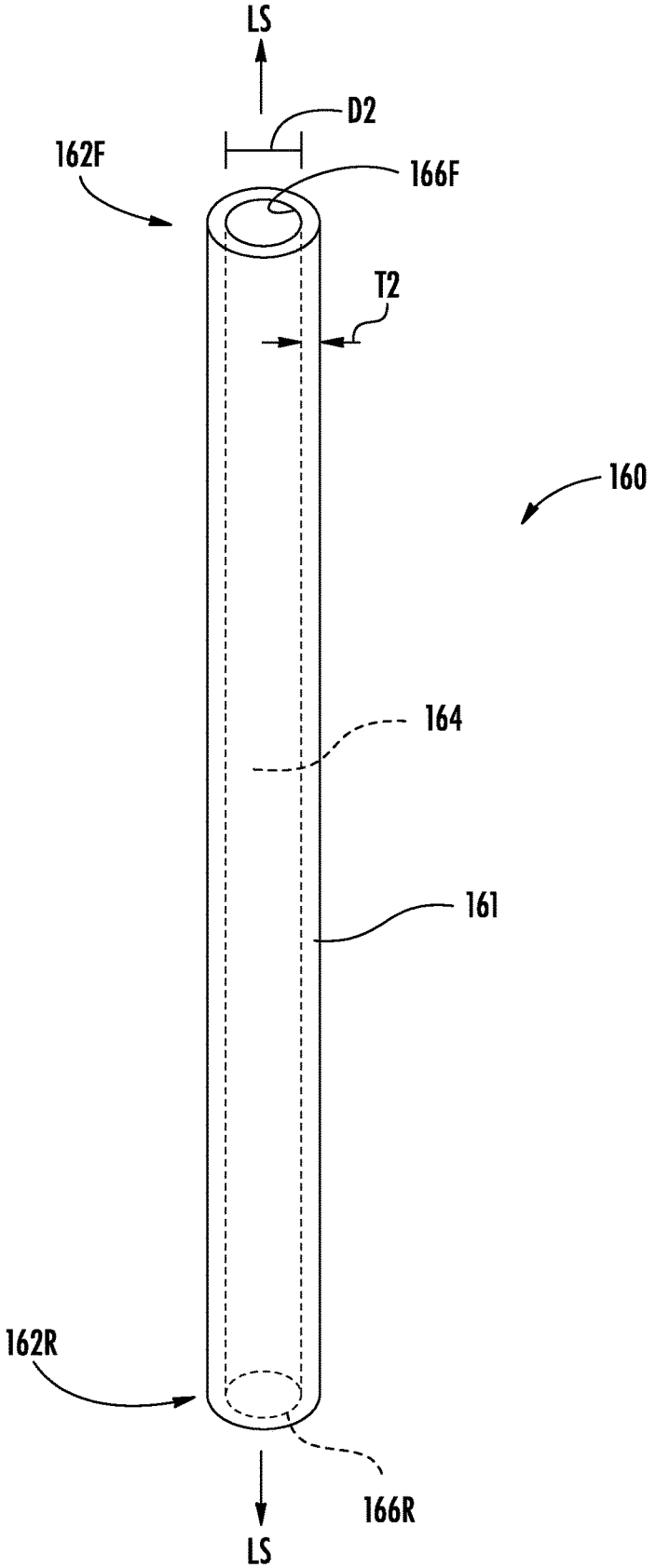
FIG. 7 is a perspective view of a shock attenuation barrier forming a part of the warhead of FIG. 4.

In some embodiments and as shown in FIGS. 4-6, the projectile array 151 substantially conforms to the curvature of the outer surface 156A of the main charge 156.

The core charge 158 is partitioned from the main charge 156 by the barrier 160, except at the end opening 166R.

In some embodiments, the ratio the combined masses of the projectiles 150 to the mass of the main explosive charge 156 is in the range of from about 0.8 to 1.6.

While the projectiles 150 are referred to herein as fragments, it will be appreciated that any suitable types of projectiles may be employed as the fragments. The projectiles 150 may be formed of any suitable shape(s). In some embodiments, the projectiles 150 are pre-formed (e.g., pre-formed fragments) as cubical or spherical in shape. The projectiles 150 may be constructed as a unitary member or members (e.g., casing) that breaks into fragments (the projected projectiles 150) when the warhead 100 is exploded. Projectile 150 size and number is scalable, and is determined by the desired energy per projectile and projectile density.

In some embodiments, the projectiles 150 each have a mass in the range of from about 0.3 grams to 1.9 grams.

In some embodiments, the number of projectiles 150 on the warhead 140 is in the range of from about 500 to 4000 projectiles.

The projectiles 150 may be formed of any suitable material(s). In some embodiments, the projectiles 150 are made from metal. In some embodiments, the projectiles 150 are made from hardened steel or tungsten-alloy material.

The shock attenuation barrier 160 may be formed of any suitable material that is effective at attenuating shock. In some embodiments, the shock attenuation barrier 160 is formed of a non-explosive material. In some embodiments, the shock attenuation barrier 160 is formed of a polymeric material. In some embodiments, the shock attenuation barrier 160 is formed of foam such as a porous foam. In some embodiments, the shock attenuation barrier 160 is formed from two or more concentric layers of different materials having different shock impedance, compressibility, and/or strength from one another.

Any suitable explosives may be used for the core charge 158 and the main charge 156 (HE explosives). Suitable HE explosives may include plastic bonded military grade types, including, PBXN-109, PBXN-110, CL-20, and AFX-757.

Any suitable explosives may be used for the boosters 152, 154. Suitable explosives may include PBXN-5 and LX-14.

As discussed below, the primary booster 152 is used to detonate the main charge 156, and the secondary booster 154 is used to detonate the core charge 158. The warhead 140 or munition 100 may further include an initiator connected with each booster 152, 154 to enable the fuze 120 to detonate the respective booster 152, 154, and thereby detonate the respective charge 156, 158.

The munition system 10 and the munition 100 may be used as follows in accordance with some embodiments. Generally, the munition can be controlled to determine the order and timing of detonation of the main charge 156 and the core charge 158 to thereby shape the warhead energetics (HE) and associated projectiles (fragments) package in a way that changes the lethal projection of the weapon. This is accomplished by the provision of the shock attenuation barrier 160 and by controlling which booster 152, 154 is actuated.

There are two functional or yield modes of operation: an area attack projection mode and a controlled strike projection mode. The two projection modes are initiated using the boosters 152, 154 at the opposed ends of the warhead 140. In the area attack projection mode of the munition 100, the main charge booster 152 is actuated to ignite the main charge 156. In the controlled strike projection mode of the munition 100, the core charge booster 154 is actuated to ignite the core charge 158.

When the munition is exploded in the area attack projection mode, the lethal area of effect is large, with a gradual falloff in lethality. The area attack projection mode may be comparable to typical fragment projection bombs and missiles. This area attack projection mode configuration is familiar to the warfighter and compatible with existing weaponeering methods.

In the controlled strike projection mode, the lethal area is relatively focused and small compared to the area attack projection mode and traditional warheads. Projectile delivery is to a well-defined area having a sharp falloff in density near the boundaries, which provides for precise lethal effects, reductions in collateral damage, and increases warfighter freedom to engage targets.

Embodiments of the invention can enable a choice of lethality modes (area attack projection or controlled strike projection) in a single, common warhead component.

Operation of the munition 100 will now be described in more detail.

Initially, the munition 100 is suitably prepared or armed. This may be executed in known manner, for example. In some embodiments, the operator may initially set or configure the munition 100 to terminate in a pre-selected projection mode (i.e., the area attack projection mode or the controlled strike projection mode), as discussed below. The munition 100 may be pre-set in one of the two projection modes so that the pre-set mode can be selected by changing or not changing the projection mode setting.

The munition 100 is launched and transits toward the target E. The munition 100 may fly to the vicinity of the target under the power of the propulsion system 104B. The flight of the munition 100 may be navigated using the guidance system 112, the targeting detection system 116, and/or commands from the remote controller 12 received via the communications transceiver 114.

Once the munition 100 reaches the vicinity of the target E, the munition 100 is triggered to explode. In some embodiments, the target E is detected by the target detection system 116 and the trigger sequence is initiated by a signal to the fuze 120 from the target detection system 116. In some embodiments, the trigger sequence in initiated automatically and programmatically and each of the steps from trigger sequence initiation to detonation are executed automatically without additional human input.

Further operation of the munition 100 depends on which projection mode is selected. As mentioned above, in some embodiments, the operator may initially set or configure the munition 100 to terminate in a pre-selected projection mode (i.e., the area attack projection mode or the controlled strike projection mode). In some embodiments, the projection mode may be selected or changed while the munition is in transit (e.g., flight) and communicated to the controller 122 via the communications transceiver 114. In some embodiments, the projection mode may be automatically and programmatically selected or changed by the controller 122 while the munition is in transit and/or as the munition 100 approaches the target E. For example, the controller 122 may determine the preferred projection mode based on characteristics of the target E, surroundings of the target E, and/or the munition 100 itself as the munition comes into proximity to the target E.

If the area attack projection mode is selected, the fuze 120 triggers the detonation of the HE explosive 156 via the main charge booster 152. In some embodiments, the fuze 120 supplies a current from the HV supply 124 to a highly sensitive initiator, which in turn sets off the booster 152. The explosion of the booster 152 detonates the main HE explosive charge 156. The fuze 120 does not detonate the core charge booster 154.

Upon detonation, the main charge 156 generates gas pressure and shock waves that drive or project the projectiles 150 outward with high energy. The projectiles 150 are projected in an area attack projection pattern PR (FIG. 2). In some embodiments, the area attack projection pattern extends about 360 degrees circumferentially about axis L-L.

More particularly, in the area attack projection mode, the booster 152 ignites the high explosive 156 at the rear end 142R of the warhead 140 (i.e., proximate the open end 162R of the shock attenuation barrier 160) and the detonation wave front travels or propagates in a forward direction outside and inside of the shock attenuation barrier 160. That is, with reference to FIG. 8, a core charge detonation wave travels in a direction DC1 through the shock barrier passage 164, and a main charge detonation wave travels in a direction DM1 through the cavity 149. The directions DC1 and DM1 both travel from the end 142R toward the end 142F. This allows the munition 100 to detonate available high explosive as quickly as possible and impart maximum kinetic energy to the fragments 150 along the full length of the main charge 156 and the warhead 140. The velocity imparted to the fragments by the HE loading is combined with the warhead's terminal approach velocity vector, resulting in a larger area of attack for the area attack mode.

The area attack projection mode against a target can be seen in FIG. 2.

Figure 11:
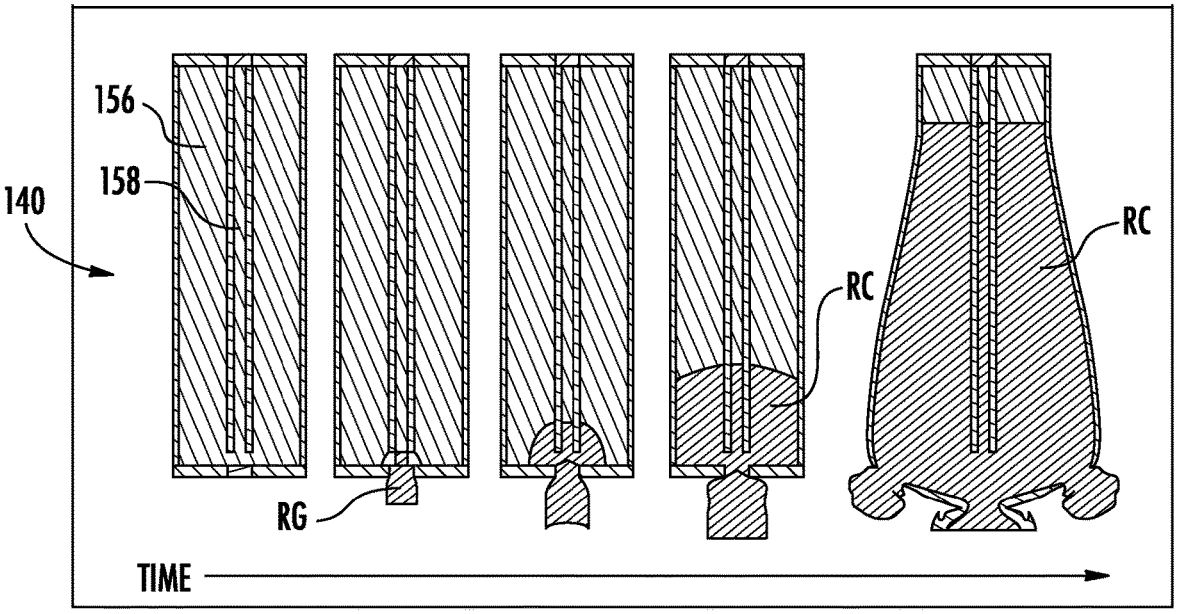
FIG. 11 is a schematic view illustrating a progression of the reaction of high explosive in the warhead of FIG. 4 over time when the warhead is operated in the controlled strike mode.

The internal warhead operation when activating the area attack mode can be seen in FIG. 11. FIG. 11 shows plots of the aforedescribed reactions over time. In FIG. 11, the regions RG represent the path of detonation product gases that are permitted to escape through the opening 146A, the regions 156, 158 represent the unexploded explosive (reactant) of the charges 156, 158, the regions RC represent reactant that has been completely consumed by the detonation event, and the regions RP represent regions of partial reaction of the explosive.

Figure 12:
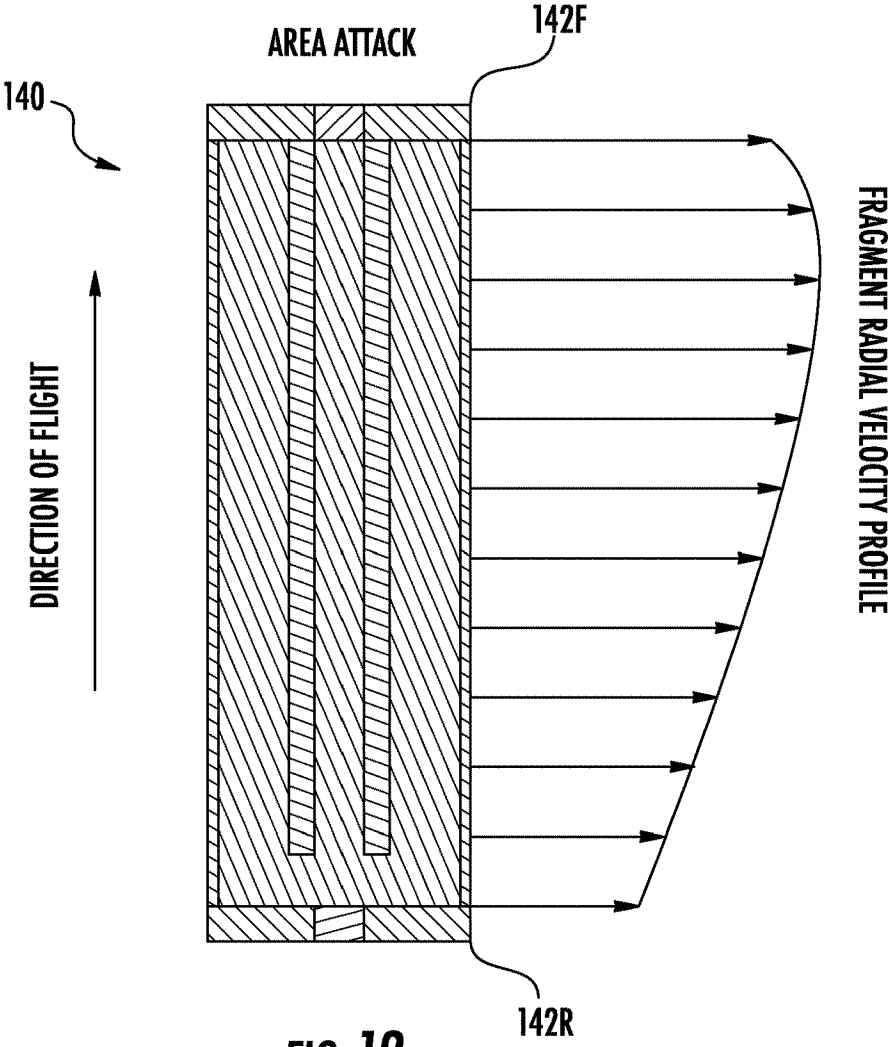
FIG. 12 is a schematic diagram illustrating a radial projectile velocity profile of the warhead of FIG. 4 when operated in the area attack mode.

The velocity profile of the projectiles 150 at each axial level or position along the warhead 140, in the area attack mode, is represented by the diagram of FIG. 12.

If the controlled strike projection mode is selected, the fuze 120 triggers the detonation of the HE explosive 158 via the core charge booster 154. In some embodiments, the fuze 120 supplies a current from the HV supply 124 to a highly sensitive initiator, which in turn sets off the booster 154. The explosion of the booster 154 detonates the core HE explosive charge 158. The fuze 120 does not detonate the main charge booster 152.

Figure 9:
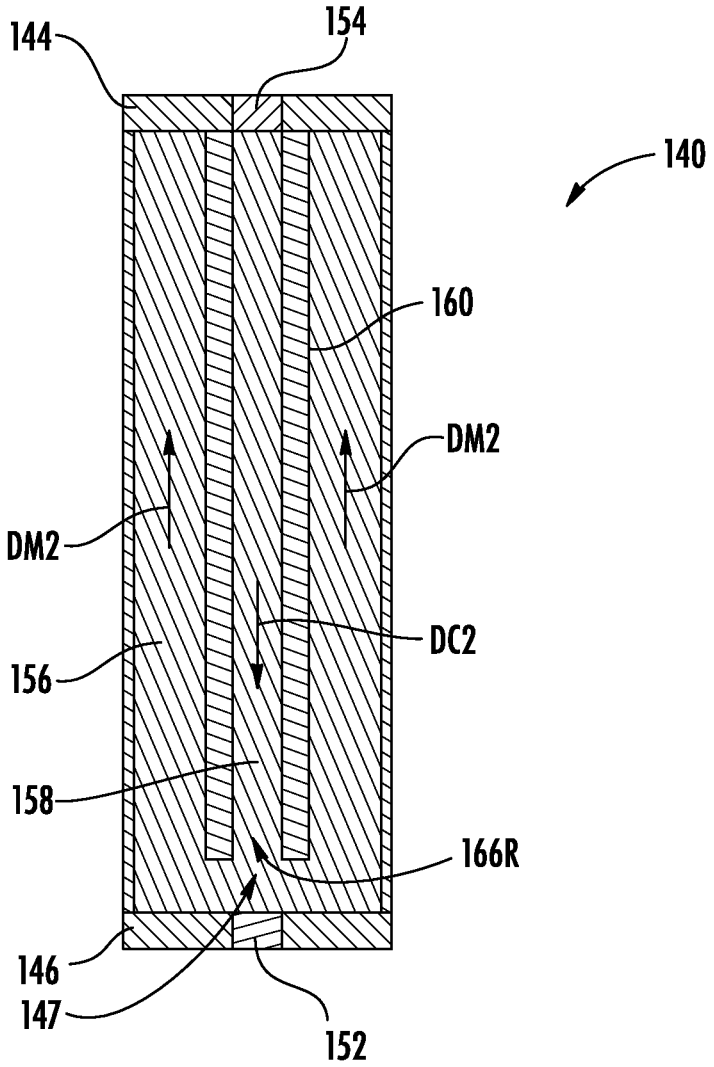
FIG. 9 is a cross-sectional view of the warhead of FIG. 4 illustrating operation of the warhead in a controlled strike mode.

The core charge booster 154 ignites the core high explosive charge 158 at the closed end 162F of the tubular cylindrical shock attenuation barrier 160. The detonation wave front of the ignited charge 158 travels or propagates within the passage 164 of the shock attenuation barrier 160 in a direction DC2 from the front end 142F of the warhead 140 to the rear end 142R, as shown in FIG. 9. As the detonation wave travels through the passage 164, the shock attenuation barrier 160 attenuates the pressure shock wave so that the shock wave energy transferred to the main charge 156 surrounding the barrier 160 is less than the shock-to-detonation wave threshold of the main charge 156.

Figure 1:
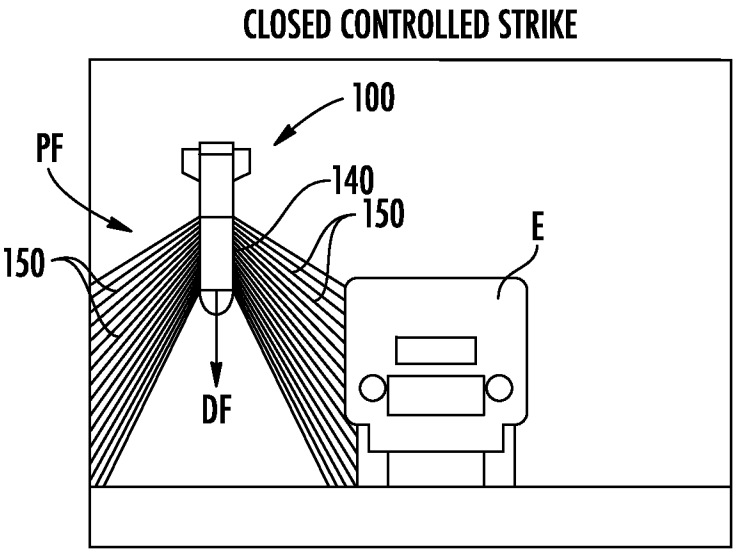
FIG. 1 is a schematic view of a munition according to embodiments of the invention being detonated in an area attack projection mode thereof.

Once the detonation wave in the core charge 158 reaches the end opening 166R, the core charge detonation wave ignites or propagates into the main charge 156 in the transition region 147 and thereby detonates the main charge 156 in this region. The detonation wave of the high explosive 156 at the rear end 142R of the warhead 140 (i.e., proximate the open end 162R of the shock attenuation barrier 160) then travels or propagates in a forward direction DM2 (FIG. 9) through the cavity 149 (i.e., outside the shock attenuation barrier 160). Upon detonation, the main charge 156 generates gas pressure and shock waves that drive or project the projectiles 150 outward with high energy. The projectiles 150 are projected in a controlled strike projection pattern PF (FIG. 1). In some embodiments, the controlled strike projection pattern extends about 360 degrees circumferentially about axis L-L. The velocity imparted to the fragments 150 by the HE loading (from detonation of the main charge 156) is combined with the warhead's terminal approach velocity vector, resulting in a reduced area of attack for the controlled strike mode.

As discussed above, the shock attenuation barrier 160 (which is made of a shock attenuation material) provides shock impedance that prevents the core charge detonation wave from detonating the main charge 156 until the core charge detonation wave exits the barrier 160 through the opening 166R. The shock attenuation barrier 160 thereby prevents the detonation wave of the charge 158 in the shock barrier passage 164 from igniting or detonating (e.g., sympathetic detonation) the surrounding main high explosive 156. This allows the detonation wave in the passage 164 to travel to the opposing end 142R of the warhead 140 before turning the corner and traveling back toward its point of origin. This has the effect of ejecting fragments at slower velocities overall as compared to the area attack mode. This also has the effect of generating a more graded fragment velocity profile where the fragments proximate the front end 142F (i.e., near the core charge booster 154) travel more slowly than those same projectiles when projected in the area attack mode. In some embodiments, in the controlled strike mode, the fragment velocity profile is graded such that the fragments proximate the front end 142F travel slower than those at the opposing end 142R.

The grading of the fragment velocities between opposing ends 142F, 142R is much increased compared to the area attack mode of operation.

The controlled strike projection mode against a target can be seen in FIG. 1.

Figure 10:
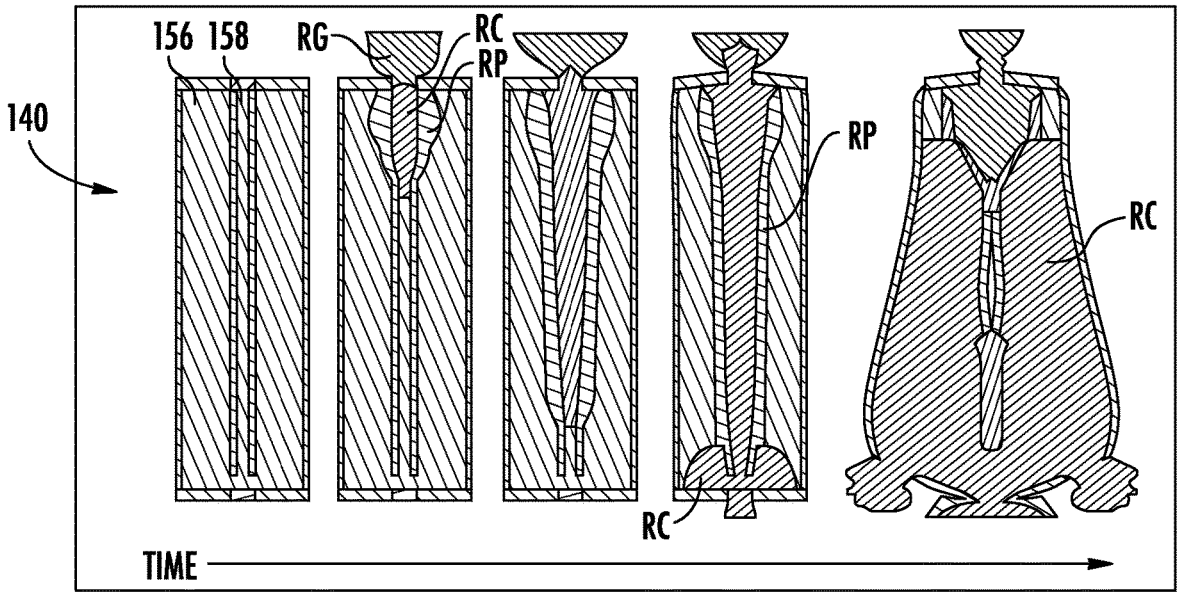
FIG. 10 is a schematic view illustrating a progression of the reaction of high explosive in the warhead of FIG. 4 over time when the warhead is operated in the area attack mode.

The internal warhead operation when activating the controlled strike mode can be seen in FIG. 10. FIG. 12 shows plots of the aforedescribed reactions over time. The regions RG, RP, RC, 156 and 158 represent the same regions as discussed above with regard to FIG. 11.

Figure 13:
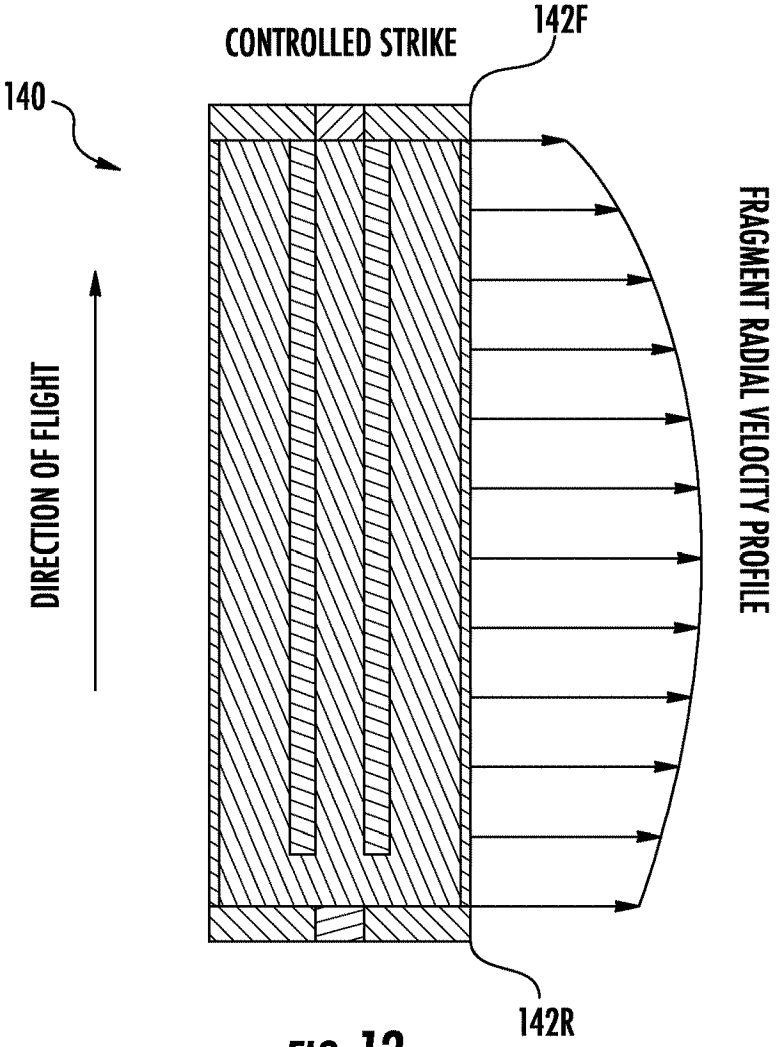
FIG. 13 is a schematic diagram illustrating a radial projectile velocity profile of the warhead of FIG. 4 when operated in the controlled strike mode.

The velocity profile of the projectiles 150 at each axial level or position along the warhead 140, in the controlled strike mode, is represented by the diagram of FIG. 13.

Thus, it will be appreciated that the tubular shock attenuation barrier 160 prevents the core charge detonation wave generated using the core charge booster 154 from immediately initiating the main charge 158, and forces the core charge detonation wave to travel nearly the entire length of the warhead 140 before reversing direction and traveling back toward the point of origin through the exterior main HE charge 158. This makes the controlled strike mode possible. Additionally, the location of the shock attenuation barrier 160 relative to the main charge booster 152 allows the core charge detonation wave to travel relatively unimpeded throughout the warhead.

The disclosed design enables a choice of projection yield or lethality modes (controlled strike and area attack) in a single warhead component without the requirement of internal moving parts. This is achieved via the centrally located cylindrical shock attenuation barrier 160, which controls the propagation of the core charge detonation wave. For the controlled strike mode, the cylindrical shock attenuation barrier 160 directs the core charge detonation wave through the central core charge 158 to the opposing end 142R of the warhead before it reverses and travels back to the booster origin. For the area attack mode, the detonation wave simultaneously enters the core charge 158 and the main charge 156, detonating the entire warhead during the first transit of the length of the warhead.

Figure 14:
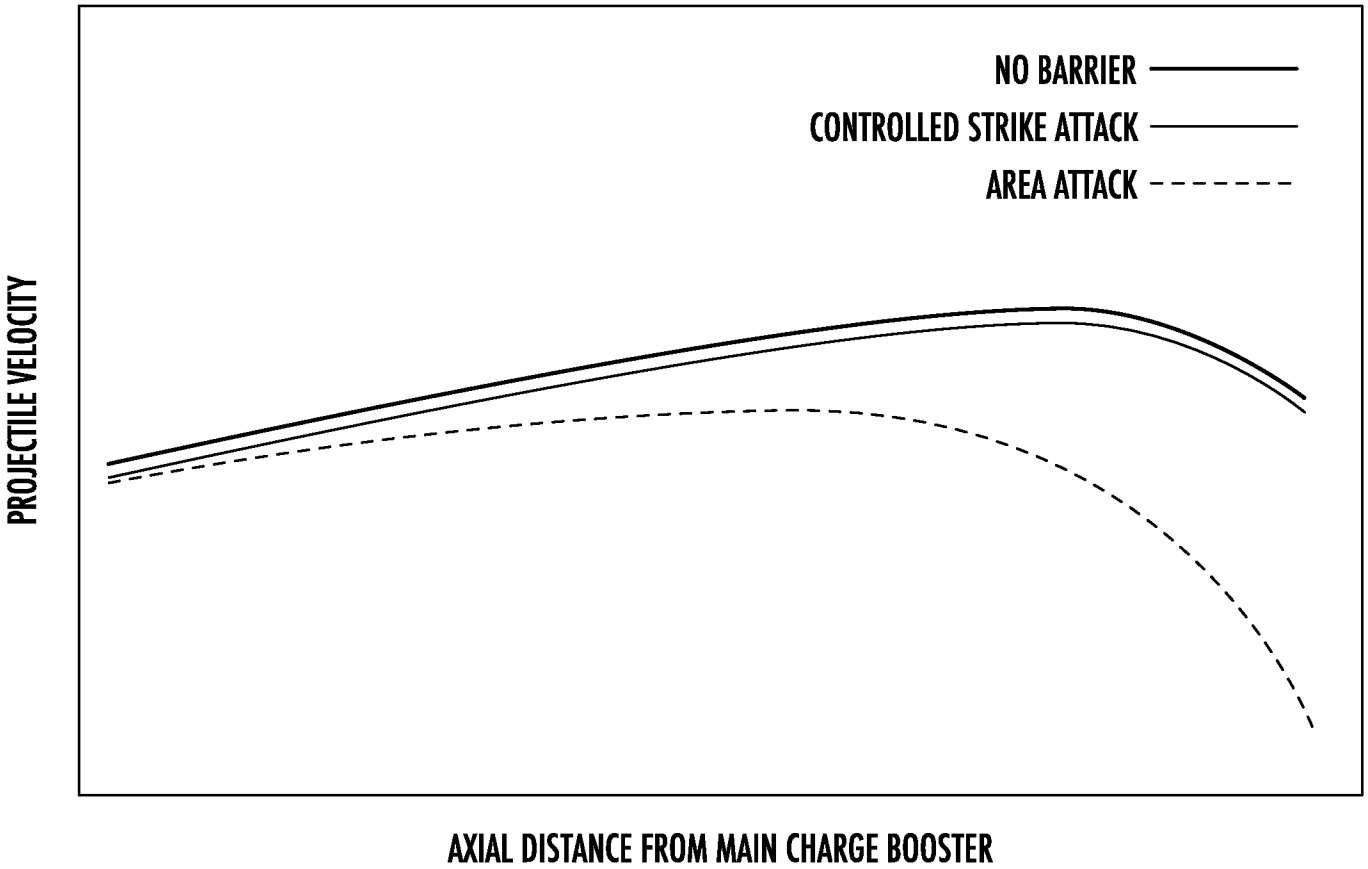
FIG. 14 is a graph illustrating projectile velocities of the projectiles of the warhead of FIG. 4 (1) when the warhead is operated in the area attack mode, (2) when the warhead is operated in the controlled strike mode, and (3) in the case of a hypothetical modified warhead not including the shock attenuation barrier.

For the controlled strike mode, the fragment velocities are reduced relative to the area attack mode and there is a significant fragment velocity gradient from one axial end 142R of the warhead to the other end 142F. This is illustrated in FIGS. 12-14. This functionality is accomplished via three mechanisms.

First, detonation product gases of the core charge 158 expanding near the core charge booster 154 are able to escape through opening 144A where the booster 154 was mounted. The booster 154 is consumed and/or ejected from the opening 144A by the detonation of the booster 154 and/or the detonation of the core charge 158. The redirected energy of these gases cannot be used to accelerate fragments.

Second, the radial expansion of the central core region of the warhead 140 must be recompressed when the detonation wave returns in direction DM2 (through the main charge 158) from the opposing end 142R of the warhead 140. During this time, the pressure loading the fragments 150 decays rapidly relative to that experienced in the area attack mode.

Third, the overall diameter of the warhead 140 is increased by the activation of the core charge 156. This reduces the efficiency with which the detonation event (i.e., the detonation wave generated by the detonated main charge 156) can accelerate the fragments 150 when returning in direction DM2 from the opposing end 142R of the warhead 140.

FIG. 13 shows a radially graded velocity profile of the fragments of the warhead when detonated in the controlled strike mode. FIG. 12 shows a radially graded velocity profile of the fragments of the warhead when detonated in the area attack mode. Each illustrated profile is generalized, and the actual shape of each profile will differ depending upon final design specifications.

The timing of the detonation of the appropriate booster 152, 154 (depending on the selected mode) may be controlled in any suitable manner. In some embodiments, the timing of the detonation is controlled using a timer 126.

In some embodiments, the timing of the detonation of the appropriate booster 152, 154 (depending on the selected mode) is controlled using an accelerometer 128. In the event the munition 100 decelerates quickly (e.g., because it has struck an object before detonating), the fuze 120 will receive a corresponding signal from the accelerometer 128. In response to the signal, the fuze 120 will initiate detonation of the appropriate booster 152, 154 as described above.

Any suitable initiation mechanisms may be used to detonate the boosters 152, 154 or the charges 156, 158.

The munition 100 can provide a number of advantages over known projectile munitions. The munition 100 provides for both a wide area of attack (area attack projection mode) and for an attack that has a tighter focus and/or a reduced energy (controlled strike projection mode).

The warhead 140 provides the controlled strike and area attack modes in a single assembly having a simple design and functionality. No moving parts are required. The two alternative modes can be selectable at any time without prior configuration. The controlled strike mode reduces risk of collateral damage.

The warhead 140 design allows generation of a monotonically varying fragment velocity gradient from one end of the munition to the other. Fragment velocities when initiating with the encapsulated core charge booster 154 will be reduced on the end 142F of the warhead nearest the controlled strike booster 154, and of normal velocity when nearest the non-encapsulated main charge booster 152.

As discussed, the centrally-located cylindrical shock attenuation barrier 160 encapsulates one booster 154 and terminates before reaching the other booster 152. The presence of the shock attenuation barrier 160 prevents immediate, sympathetic detonation of the main charge 156 when initiating the core charge 158 with the encapsulated core charge booster 154. This forces the detonation wave to traverse most or nearly the entire warhead within the core charge 158 before returning to the point of origin through the main charge 158 when using the encapsulated core charge booster 154 for initiation.

Munitions as described herein can provide a wide area, radial projection mode similar to existing warheads. However, the inventive munitions can provide an additional capability of a controlled strike mode that focuses projectiles within a smaller envelope by changing the projected velocity of the fragments. Selecting between modes does not require modification of the warhead and may be done at any time prior to weapon launch by selecting one of the two boosters 152, 154 for initiation at target. The focused fragment pattern generated by the controlled strike mode decreases risk of collateral damage, increases probability of more hits on target, and increases warhead flexibility in theater.

In some embodiments, the controlled strike mode is enabled by fitting the cylindrical shock attenuation barrier 160 in such a way as to prevent the detonation product gases from the core charge 158 from passing around the barrier 160 (in which case they would load the main charge 156 directly). This can be accomplished by a variety of methods such as by insetting the end 162F of the shock attenuation barrier 160 into the tamping mass end plate 144.

Another important aspect of the functionality is that the barrier 160 prevents sympathetic detonation of the main charge 156 when the core charge 158 is initiated by the core charge booster 154. This allows the first detonation wave to be directed to the opposing end of the warhead before returning to the point of origin through the main charge 156 as seen in FIGS. 9 and 10. This enables the warhead to achieve lower fragment velocities and the graded velocity profile when using the controlled strike mode.

The warhead 140 can be constructed as a single, integrated, modular assembly that can be simply attached and connected to other components of the munition. The warhead 140 can be configured as a "drop-in" replacement for existing warheads so that existing munition designs can be repurposed or retrofitted with the warhead 140. The area attack projection mode provides equivalent capability to legacy systems, supporting existing warfighter tactics. The warhead 140 is scalable, and could be sized to fit into missile systems of different types and shapes. Warheads according to embodiments of the invention can be constructed to be of near identical weight, volume and center of gravity to the production warheads they are designed to replace.

The munition 100 can be simply and robustly controlled using a single selection command.

The deployment mode (area attack projection mode or controlled strike projection mode) can be selectable in flight so that no prior reconfiguration is needed.

By enabling customization of the projectile dispersion, the munition 100 can execute a precision or more focused attack and thereby provide a reduced risk of collateral damage. The munition 100 can provide focused attack capability under any engagement conditions and is not dependent on the terminal velocity or angle of attack of the munition.

Figure 15:
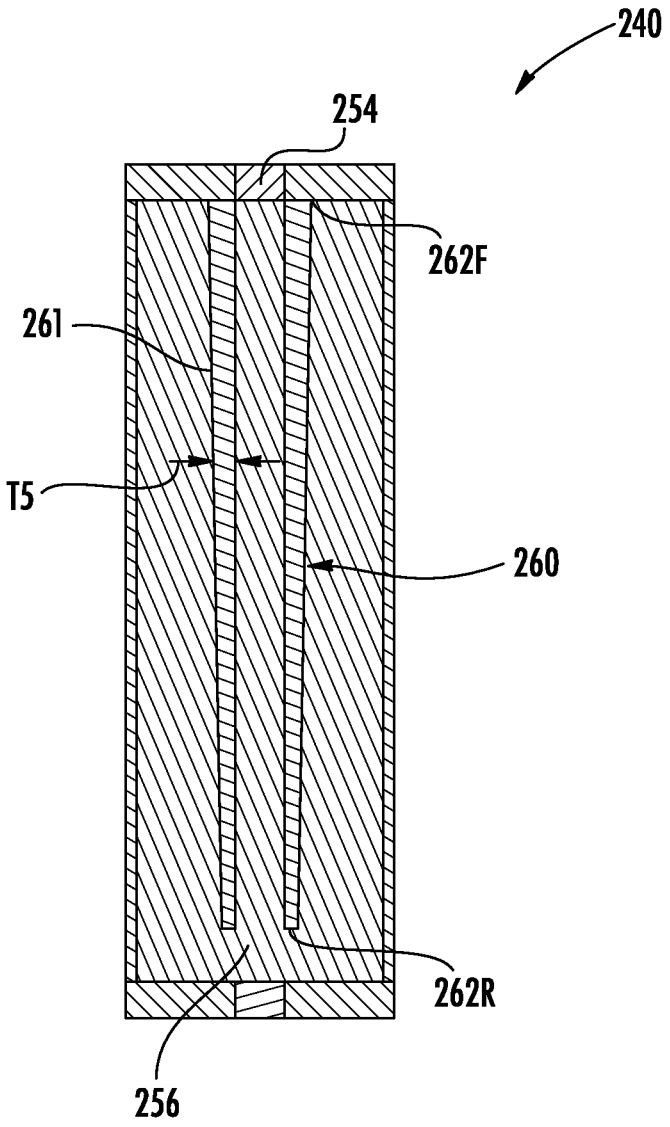
FIG. 15 is a cross-sectional view of a warhead according to further embodiments.

With reference to FIG. 15, a warhead 240 according to further embodiments is shown therein. The warhead 240 can be used in the munition 100 in place of the warhead 140. The warhead 240 is constructed and can be used in the same manner as described above for the munition 100 and the warhead 140, except as follows.

The warhead 240 differs from the warhead 140 in that the thickness T5 of the wall 261 of the shock attenuation barrier 260 tapers in the direction from the end 262F adjacent the core charge booster 254 to the end 262R adjacent the main charge 256. The tapered thickness shock attenuation barrier 260 reduces the amount of displaced HE of the main charge 256 and thereby increases the area attack mode fragment velocities.

Figure 16:
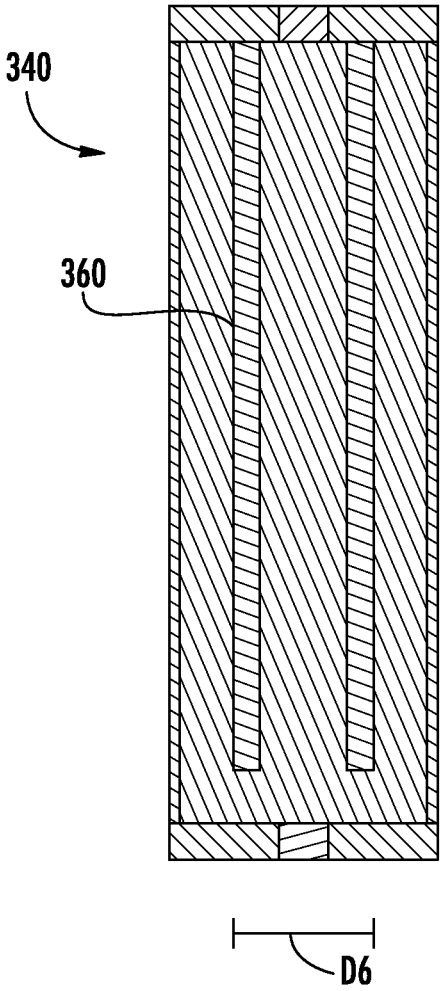
FIG. 16 is a cross-sectional view of a warhead according to further embodiments.

With reference to FIG. 16, a warhead 340 according to further embodiments is shown therein. The warhead 340 can be used in the munition 100 in place of the warhead 140. The warhead 340 is constructed and can be used in the same manner as described above for the munition 100 and the warhead 340, except as follows.

The warhead 340 differs from the warhead 140 in that the shock attenuation barrier 360 has a larger outer diameter D6. Compared to the warhead 140, this larger diameter shock attenuation barrier 360 increases deformation rate of the warhead and accelerates energy dissipation via product gas transport out of the core region. This allows steeper fragment velocity gradients and lower overall velocities for more focused controlled strike mode.

Figure 17:
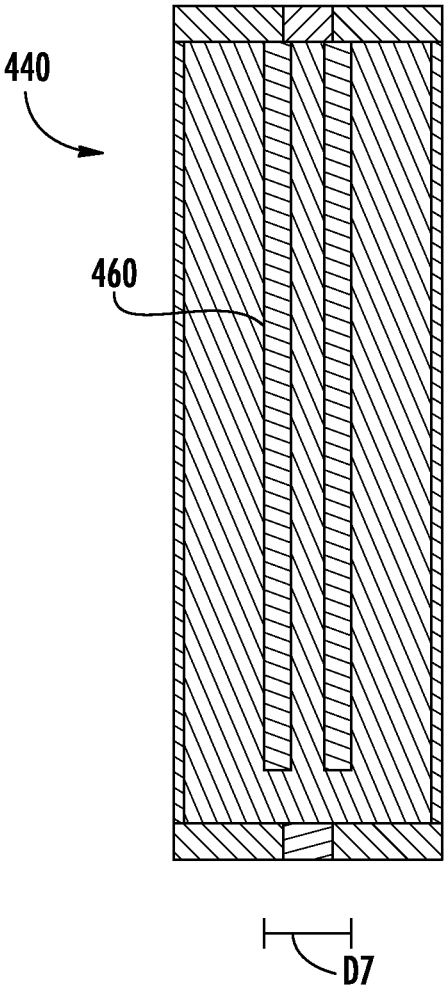
FIG. 17 is a cross-sectional view of a warhead according to further embodiments.

With reference to FIG. 17, a warhead 440 according to further embodiments is shown therein. The warhead 440 can be used in the munition 100 in place of the warhead 140. The warhead 440 is constructed and can be used in the same manner as described above for the munition 100 and the warhead 140, except as follows.

The warhead 440 differs from the warhead 140 in that the shock attenuation barrier 360 has a smaller outer diameter D7. Compared to the warhead 140, this smaller diameter of the shock attenuation barrier 460 reduces volume of the shock attenuation barrier 460, which minimizes parasitic loss due to displaced high explosive (HE). A smaller diameter also reduces mass of the barrier 460, minimizing parasitic loss by reducing barrier mass which the HE accelerates. A smaller diameter also locates most barrier mass near the central axis of the warhead where radial expansion velocities are lowest, minimizing parasitic loss by reducing the velocity to which the barrier mass is accelerated.

Figures 18, 19, 20:
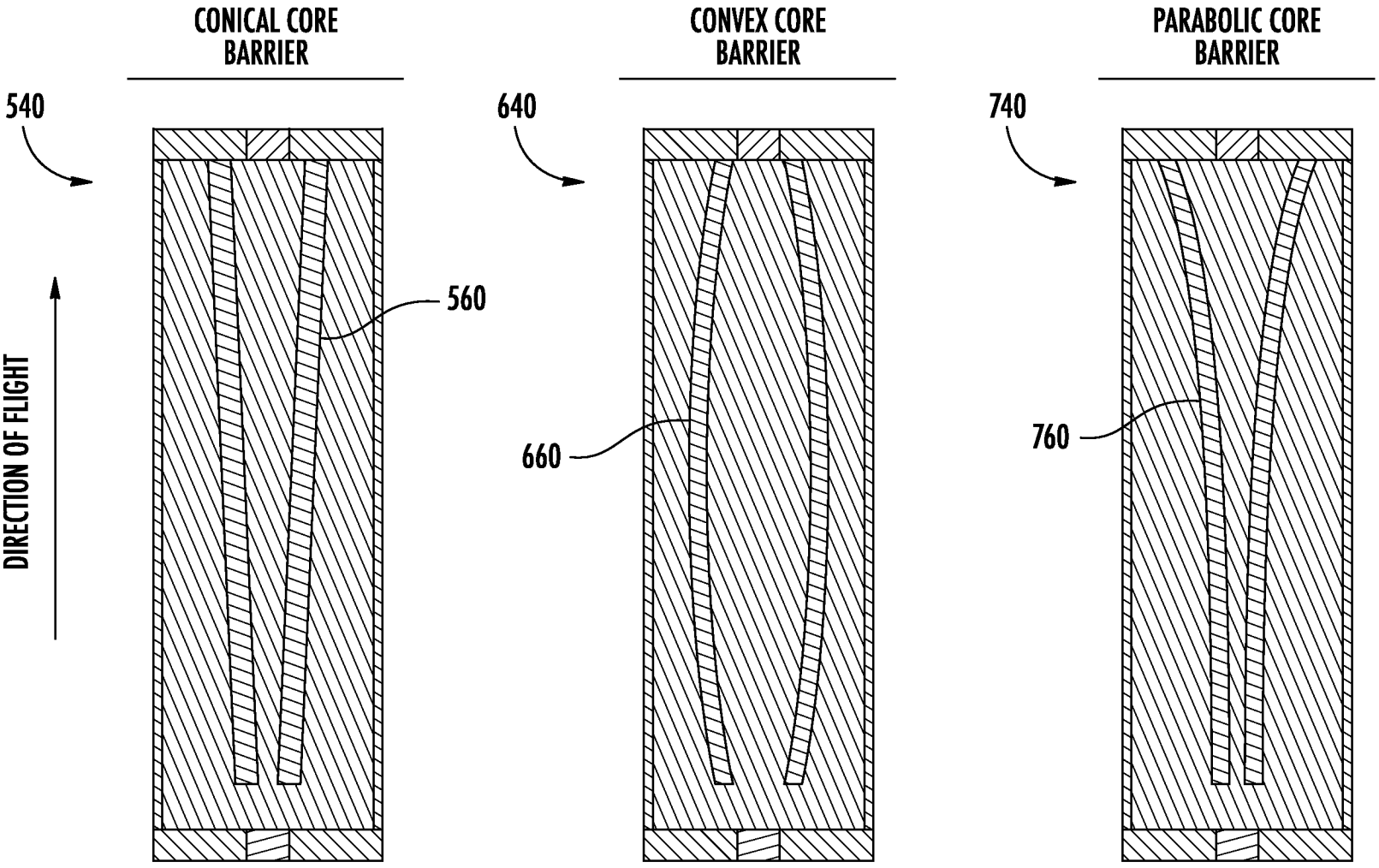
FIG. 18 is a cross-sectional view of a warhead according to further embodiments.
FIG. 19 is a cross-sectional view of a warhead according to further embodiments.
FIG. 20 is a cross-sectional view of a warhead according to further embodiments.

With reference to FIGS. 18-20, warheads 540, 640, and 740 according to further embodiments are shown therein. Each of the warheads 540, 640, and 740 can be used in the munition 100 in place of the warhead 140. The warheads 540, 640, and 740 are constructed and can be used in the same manner as described above for the munition 100 and the warhead 140, except as follows.

Each of the warheads 540, 640, and 740 is provided with a shock attenuation barrier 560, 660, and 760 having a geometry that is symmetrical about the lengthwise axis L-L an inner diameter and an outer diameter that each vary along the length of the shock attenuation barrier. These geometries can be used to develop operationally optimal shock attenuation barriers. Such shapes can be used to tailor fragment footprint patterns in controlled strike mode with varying effects on area attack mode.

Conical shock attenuation barrier shapes (e.g., the shock attenuation barrier 560) allow more focused controlled strike modes while preserving area attack mode fragment velocities more effectively than larger constant diameter barriers.

Figure 21:
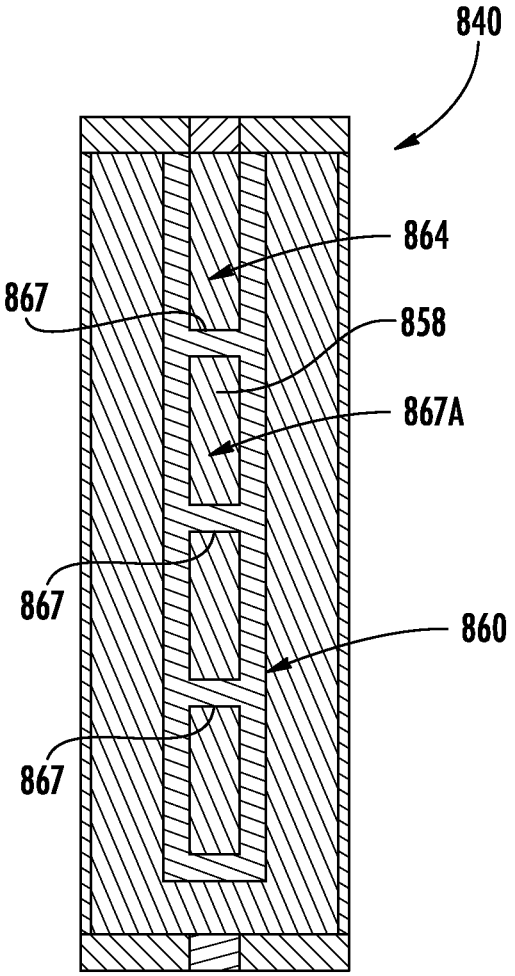
FIG. 21 is a cross-sectional view of a warhead according to further embodiments.

With reference to FIG. 21, a warhead 840 according to further embodiments is shown therein. The warhead 840 can be used in the munition 100 in place of the warhead 140. The warhead 840 is constructed and can be used in the same manner as described above for the munition 100 and the warhead 140, except as follows.

The warhead 840 differs from the warhead 140 in that the shock attenuation barrier 860 of the warhead 840 includes a series of periodic, axially spaced apart obstructions in the form of walls 867 extending transversely across the passage 864 of the shock attenuation barrier 860. In some embodiments, each transverse wall 867 fully occludes the passage 864 so that the passage 864 is thereby partitioned into a series of cavities 867A each containing a mass of the core charge 858.

Figure 22:
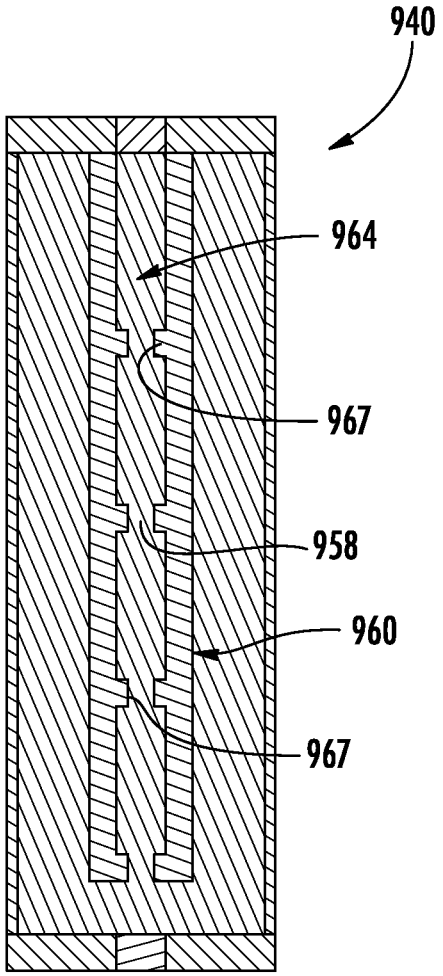
FIG. 22 is a cross-sectional view of a warhead according to further embodiments.

With reference to FIG. 22, a warhead 940 according to further embodiments is shown therein. The warhead 940 can be used in the munition 100 in place of the warhead 140. The warhead 940 differs from the warhead 140 in that the shock attenuation barrier 960 of the warhead 940 includes a series of periodic, axially spaced apart obstructions in the form of integral, annular flanges 967 projecting transversely across and radially inwardly into the passage 964 of the shock attenuation barrier 960. Each flange 967 defines an opening 967A that is also filled with the core charge 958.

Periodic obstructions or constrictions 867, 967 of the warheads 840, 940 provide breaks in the core charge as well as shock attenuation media to slow the detonation wave of the core charge 858, 958, and allow additional time for expansion of the core charge. In this way, the obstructions and constrictions provide, as compared to the open arrangement of the barrier 160 of the warhead 140, decreased fragment velocities and a more pronounced velocity profile when the warhead 840, 940 is detonated in the controlled strike mode.

Figure 23:
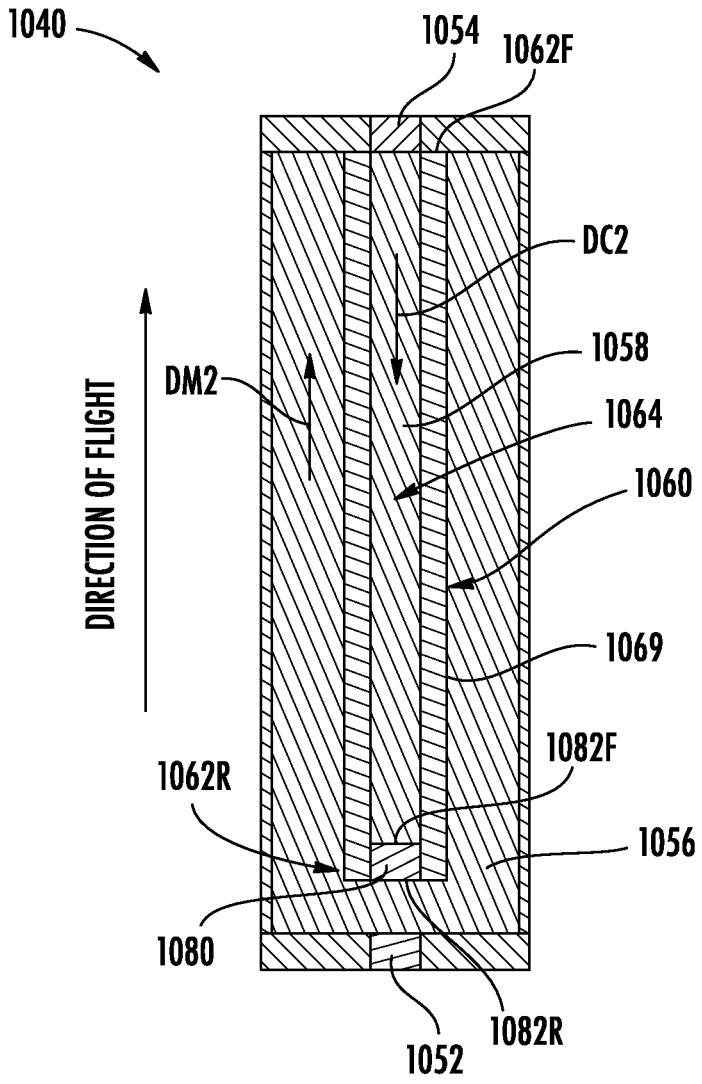
FIG. 23 is a cross-sectional view of a warhead according to further embodiments.

With reference to FIG. 23, a warhead 1040 according to further embodiments is shown therein. The warhead 1040 can be used in the munition 100 in place of the warhead 140. The warhead 1040 is constructed and can be used in the same manner as described above for the munition 100 and the warhead 140, except as follows.

The warhead 1040 includes a central shock attenuation barrier 1060. The shock attenuation barrier 1060 includes a tubular main shock attenuation barrier 1069 corresponding to the shock attenuation barrier 160. The warhead 1040 differs from the warhead 140 in that the shock attenuation barrier 1060 further includes an end or terminal shock attenuation wall or barrier 1080 that is located at the terminal end 1062R of the passage 1064 or in the passage 1064 adjacent the terminal end 1062R. The cylindrical shock attenuation barrier 1060 is thereby terminated with a barrier at the end of the shock attenuation barrier 1060 adjacent the area attack mode booster 1052.

In some embodiments, the terminal shock attenuation barrier 1080 is a separate component secured to the main shock attenuation barrier 1069. In some embodiments, the terminal shock attenuation barrier 1080 is integrally formed with (e.g., monolithic with) the main shock attenuation barrier 1069. In some embodiments, the terminal shock attenuation barrier 1080 has a planar face 1082F facing the end 1062F of the shock attenuation barrier 1060. In some embodiments, the terminal shock attenuation barrier 1080 fully spans and occludes the inner diameter of the passage 1064.

The warhead 1040 operates in the same manner as the warhead 140 when the area attack mode is selected and executed. In some embodiments (e.g., as discussed below), the warhead 1040 is constructed such that, when the main charge booster 1052 is first detonated to initiate the area attack mode, the detonation wave of the main charge 1056 is transferred through the main shock attenuation barrier 1069 and/or the terminal shock attenuation barrier 1080 to the unexploded core charge 1056 at sufficient energy to exceed the shock-to-detonation threshold of the core charge 1058, so that the main charge detonation wave detonates the core charge 1058.

When the controlled strike mode is selected, the fuze 120 detonates the core charge booster 1054 as described above for the booster 154. The core charge 1058 is thereby detonated and a core charge detonation wave propagates through the passage 1064 in the direction DC2 as discussed above. However, in the warhead 1040, the main shock attenuation barrier 1069 and the terminal shock attenuation barrier 1080 attenuate or fully arrest the core charge detonation wave and prevent propagation of the core charge detonation wave into the main charge 1056. Accordingly, the shock attenuation barrier 1060 prevents the core charge detonation wave from detonating the main charge 1056.

Continuing in the controlled strike mode, after a predetermined delay from the time the core booster 1054 is activated, the fuze 120 then detonates the main charge booster 1052 to complete the activation of the warhead 1040. The main charge 1056 will then detonate to provide a controlled strike projection of the projectiles 1050 as discussed above.

The operation and initiation sequence of the warhead 1040 in the controlled strike mode serves to further delay the initiation of the main charge 1056 in order to maximize the escape of product gases, expansion of the core, and expansion of the munition's overall diameter. In this way, the warhead can project the projectiles in the controlled strike mode with significantly slower projectiles and a more pronounced projectile velocity profile. Detonation of the main charge 1056 can be delayed until a desired time and then initiated by the main charge booster 1052, allowing selection of a range of fragment footprints on the ground. The predetermined delay could be variable and chosen to generate and allow selection from a range of projectile footprints on the ground. It would also be possible to forgo the initiation of the area attack mode booster 1052 if the situation dictated it, such as if deflagration of the main charge was desired.

According to some embodiments, the terminal shock attenuation barrier 1080 is asymmetric in that it attenuates the shock significantly more in one direction than in the other. More particularly, the terminal shock attenuation barrier 1080 will attenuate the detonation wave traveling from the core charge 1058 (through the core shock attenuation barrier passage 1064 and incident on the face 1082F) into the main charge 1056 in the direction DC2 to an extent that the transferred shock pressure does not exceed the shock-to-detonation threshold of the main charge 1056. On the other hand, the terminal shock attenuation barrier 1080 will allow a detonation wave traveling from the main charge 1056 in the direction DM2 to enter the core charge 1058 through the end 1062R (and incident on the face 1082R) at a pressure that exceeds the shock-to-detonation threshold of the core charge 1058, and detonate the core charge 1058.

In some embodiments, the terminal shock attenuation barrier 1080 is an asymmetric shock attenuation barrier constructed as described below for the asymmetric shock attenuation barrier 1180 and with reference to FIGS. 24-31.

With reference to FIGS. 24-31, an asymmetric shock attenuation barrier 1180 and a munition 1100 including the same according to some embodiments are shown therein. The munition 1100 may be or form a part of a warhead, for example. The asymmetric barrier 1180 includes multiple shock barrier layers having different densities. Asymmetric shock attenuation barriers as described can be used to construct multi-function munitions intended for use against personnel and materiel. In general, the asymmetric shock attenuation barrier 1180 enables the strong attenuation of shock waves traveling through the barrier 1180 in a first prescribed direction and the weak attenuation of shock waves traveling through the barrier 1180 in the opposite prescribed direction. The invention facilitates the design of multi-functional munitions with high-performance and unique functional models which may not be achievable with symmetric shock attenuation barriers. Moreover, the asymmetric barrier 1180 may be volumetrically-efficient.

Figure 24:
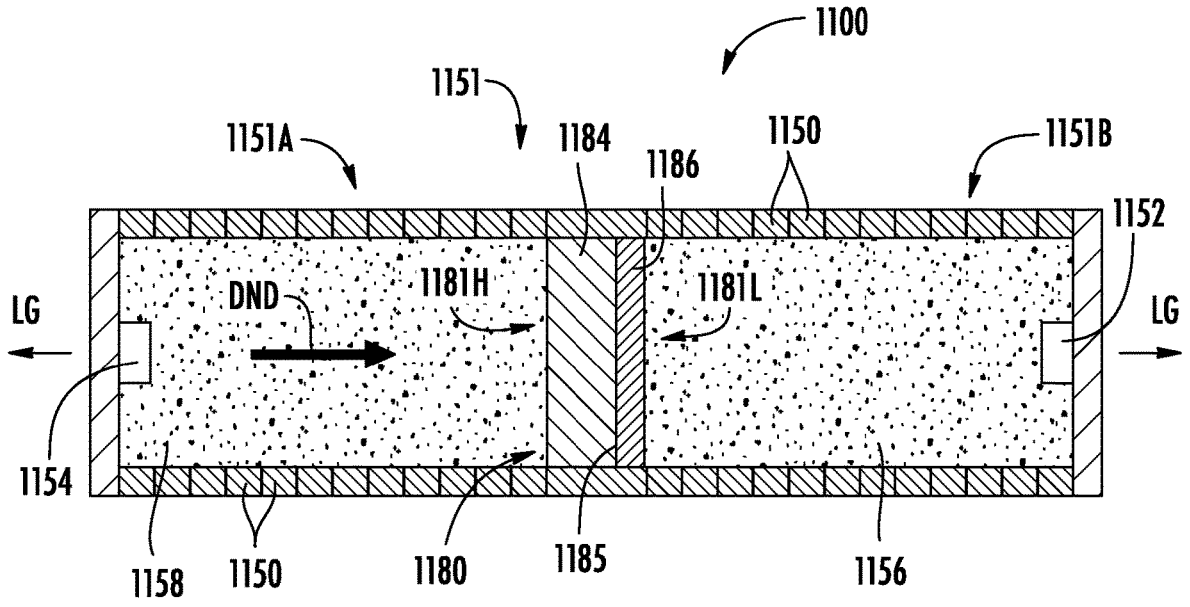
FIG. 24 is a cross-sectional view of a munition according to further embodiments of the invention, wherein activation in a first activation mode of the munition is indicated.

With reference to FIG. 24, the exemplary munition 1100 includes a first high explosive charge 1158 and a second high explosive charge 1156. The munition 1100 may further include a casing 1151, for example, surrounding the explosive charges 1156, 1158. The casing 1151 may be or include a shell, projectiles (e.g., preformed projectile fragments), a shaped charge, or any other suitable components for delivering a desired damage effect. The casing 1151 includes a first section 1151A surrounding the first explosive charge 1158, and a second section 1151B surrounding the second explosive charge 1156. The casing 1151 of FIG. 24 is illustrated including arrays of preformed projectiles 1150; however, this configuration is only exemplary and the casing 1151 may take other forms.

Figure 26:
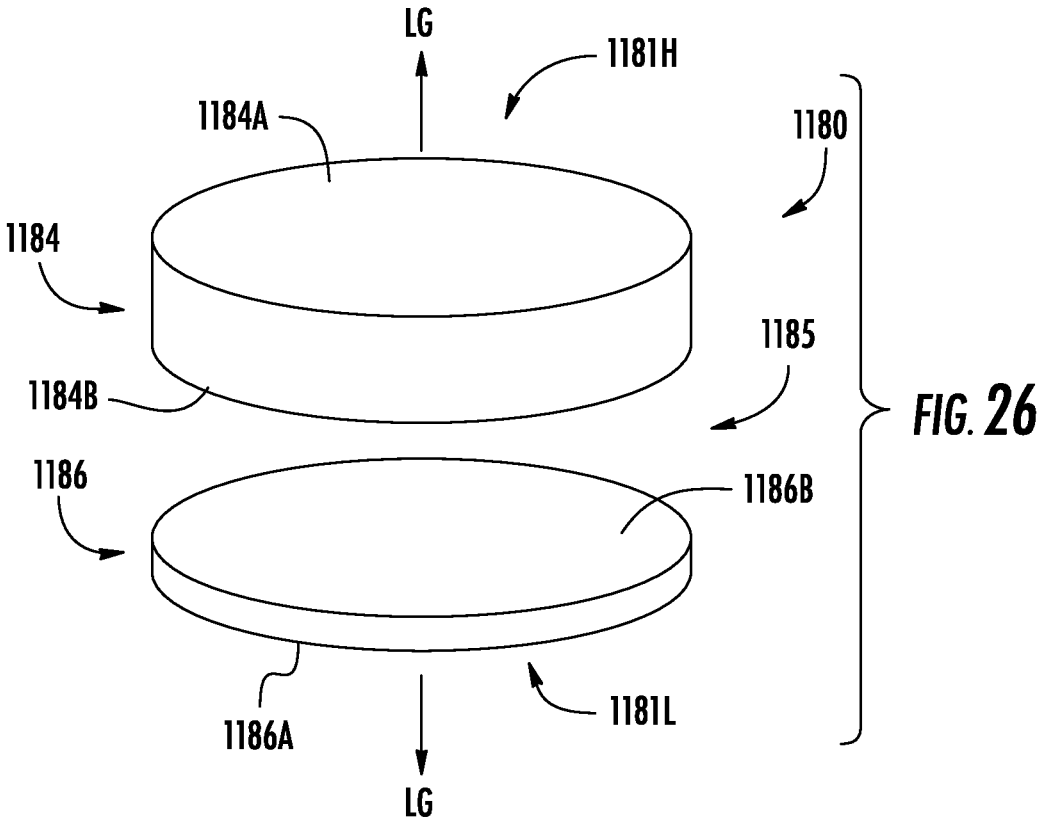
FIG. 26 is an exploded, perspective view of an asymmetric shock attenuation barrier forming a part of the munition of FIG. 24.

With reference to FIGS. 24 and 26, the shock attenuation barrier 1180 consists of two shock barrier layers 1184 and 1186. The shock attenuation barrier 1180 has a shock attenuation barrier axis LG-LG. The barrier layers 1184 and 1186 are arranged serially along the axis LG-LG between the first explosive charge 1158 and the second explosive charge 1156.

The shock attenuation barrier 1180 has a first or high density (HD) side 1181H and an opposing second or low density (LD) side 1181L. The barrier layer 1184 includes an outer face 1184A (on the HD side 1181H) and an opposing inner face 1184B. The barrier layer 1186 includes an outer face 1186A (on the LD side 1181L) and an opposing inner face 1186B. The inner face 1184B engages the inner surface 1186B a barrier layer interface 1185. In some embodiments, the faces 1184A, 1184B, 1186A, 1186B are each substantially planar.

The barrier layer 1184 has a higher density than the barrier layer 1186 and higher shock impedance than the barrier layer 1186. The barrier layers 1184 and 1186 may be referred to herein as the high density (HD) barrier layer 1184 and the low density (LD) barrier layer 1186. Further aspects of the barrier layers 1184, 1186 are discussed hereinbelow.

The exemplary munition 1100 further includes a first detonator 1154 and a second detonator 1152. The first detonator 1154 is configured and positioned to detonate the first explosive charge 1158. The second detonator 1152 is configured and positioned to detonate the second explosive charge 1156. As discussed below, when the first detonator is activated (in a first activation mode), the first detonator 1154 will detonate the first charge 1158, and but the detonation wave generated by the first charge 1158 will not detonate the second charge 1156. When the second detonator is activated (in a second activation mode) the second detonator 1152 will detonate the second charge 1156, and a detonation wave generated by the second charge 1156 will in turn detonate the first charge 1158.

However, it will be appreciated that the munition may take other forms, depending on its operational objectives.

The shock attenuation barrier 1180 provides asymmetric shock attenuation depending upon the side from which the shock enters the barrier 1180. The shock attenuation barrier 1180 uses two layers, namely, a first layer of high-density, high-strength material(s) 1184 and a second layer of low-density, high-compressibility material(s) 1186 to accomplish this functionality.

In use, the impedance mismatch between the barrier layers 1184, 1186 varies significantly over time so that shock attenuation at the interface 1185 between the barrier layers 1184, 1186 correspondingly varies. Moreover, the rate at which the impedance mismatch varies depends on the direction of the detonation shock wave (i.e., which side the shock wave enters the barrier 1180 from). The rate of change in the impedance mismatch is greater when the shock wave enters from the low density side 1181L than when the shock wave enters from the high density side 1181H.

Additionally, the barrier 1180 obtains high volumetric efficiency by using high-density material(s) that results in a massive barrier that can store shock energy as kinetic energy and distribute it over time and space.

Figure 27:
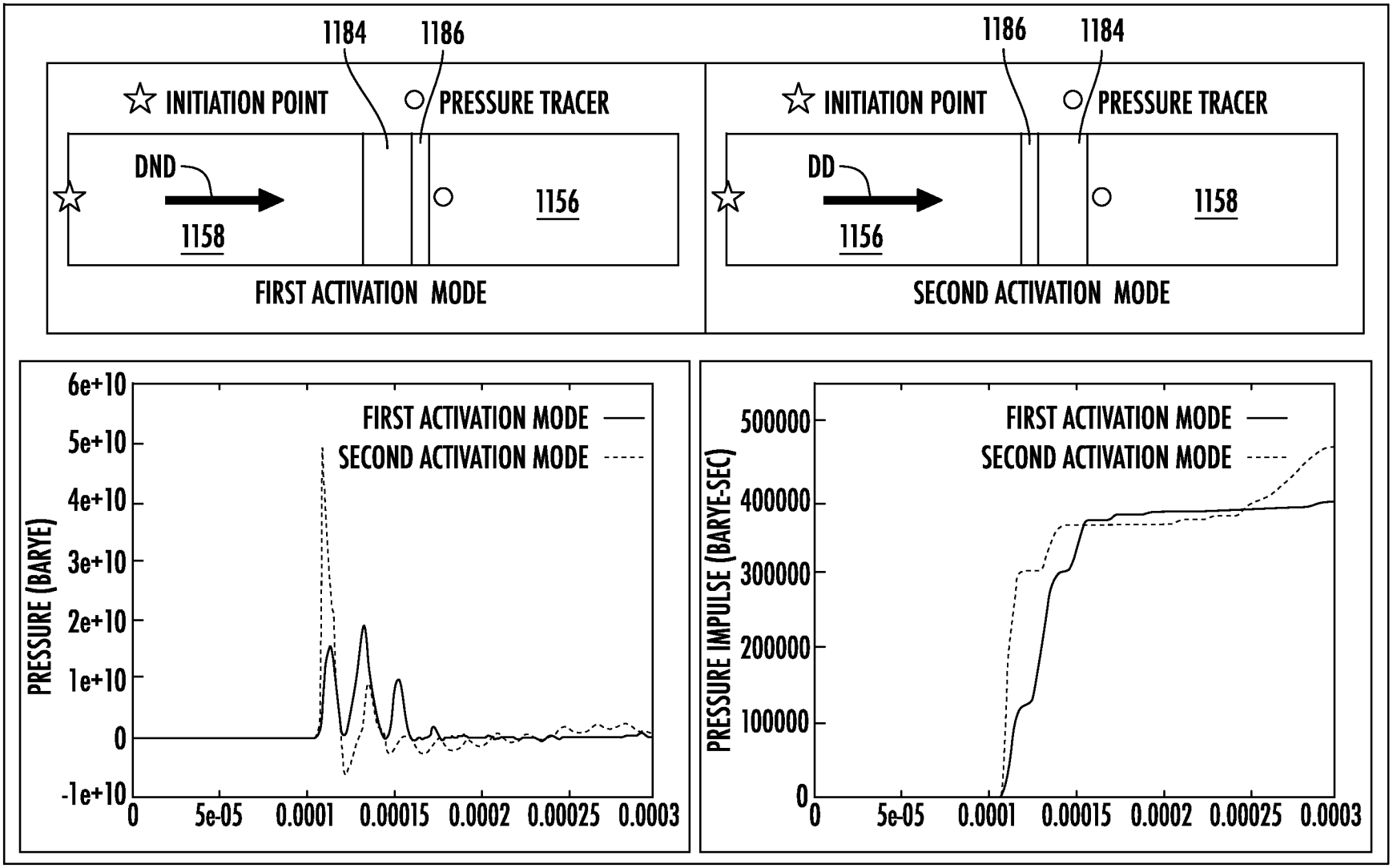
FIG. 27 includes graphs illustrating the progressions of shock wave pressures in the munition of FIG. 24, when activated in each of the first and second activation modes.
Figure 28:
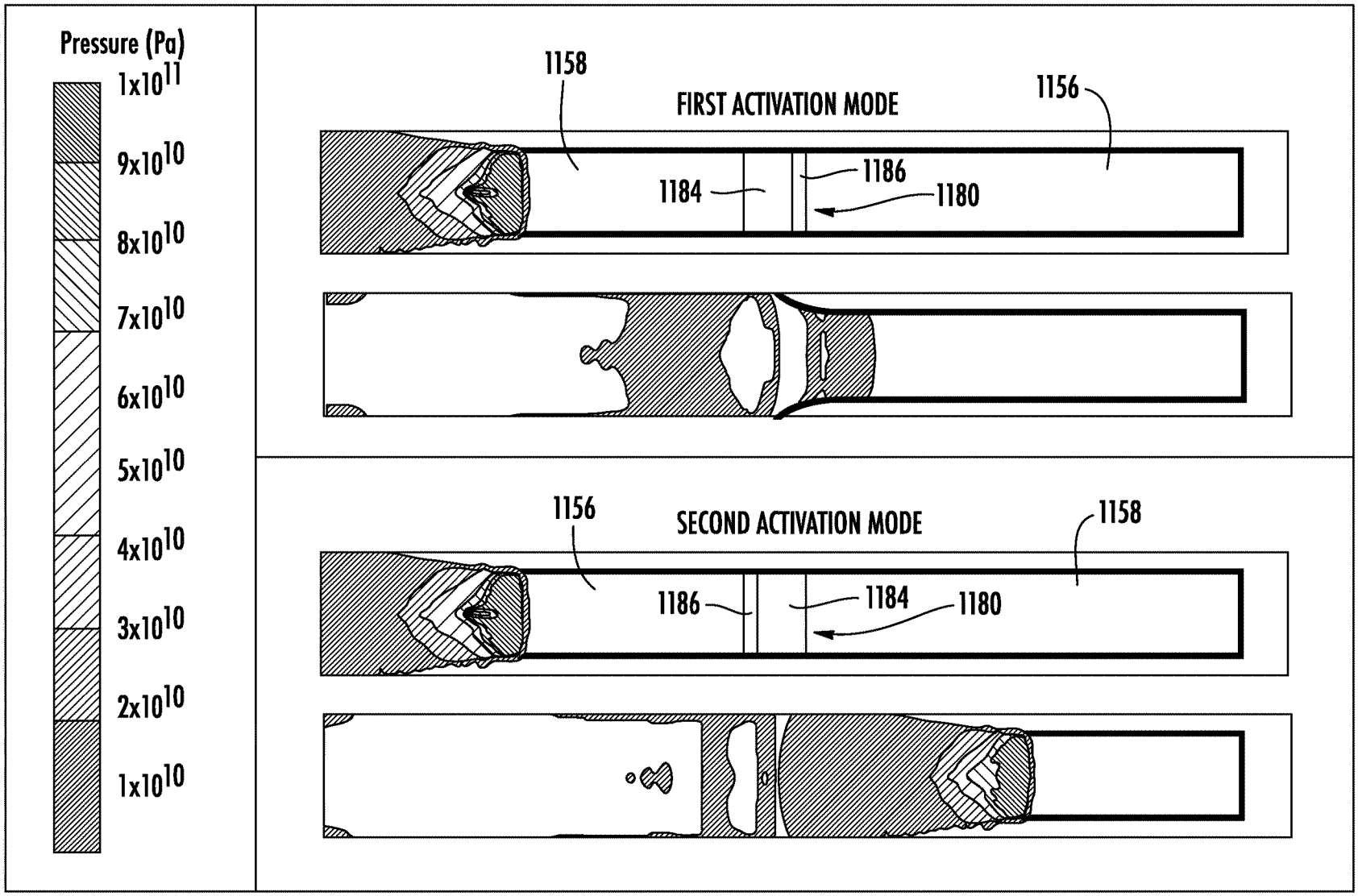
FIG. 28 includes schematic views illustrating the progressions of shock wave pressures in the munition of FIG. 24, when activated in each of the first and second activation modes.

Turning now to the operation of the munition 1100 and the shock attenuation barrier 1180 in more detail, FIGS. 27 and 28 illustrate simulated performance of an exemplary munition 1100 and shock attenuation barrier 1180 according to some embodiments. In the exemplary shock attenuation barrier 1180, the high density barrier layer 1184 is formed of aluminum and the low density barrier layer 1186 is formed of foam. The assigned representative impedance values for the aluminum layer 1184, the foam layer 1186, and the high explosives 1156, 1158 are as follows:

High explosive (1156, 1158) when unreacted=$2.9 \times 10^5$ g/cm$^2$-sec High explosive (1156, 1158) when detonated=$1.6 \times 10^6$ g/cm$^2$-sec Aluminum (1184) when unloaded and uncompressed=$4.5 \times 10^5$ g/cm$^2$-sec Aluminum (1184) when fully loaded and compressed=$1.6 \times 10^6$ g/cm$^2$-sec Foam (1186) when unloaded and uncompressed=$7.1 \times 10^4$ g/cm$^2$-sec Foam (1186) when fully loaded and compressed=$1.3 \times 10^6$ g/cm$^2$-sec.

As used herein, the "unloaded and uncompressed impedance" of a barrier layer 1184, 1186 refers to the shock impedance of the barrier layer 1184, 1186 in its initial state, at standard temperature and pressure, in the assembled munition 1100, prior to introduction of any shock pressure or other load generated by detonation of either explosive 1156, 1158. The "fully loaded and compressed impedance" of a barrier layer 1184, 1186 refers to the shock impedance of the barrier layer 1184, 1186 at its highest pressure and density after interacting with the detonation wave or any shock wave generated by the detonation wave (typically, this state of the shock barrier material will occur nearly instantly after the interaction).

In the first activation mode, the first explosive charge 1158 is detonated by the detonator 1154 so that the first explosive charge 1158 in turn generates a first detonation shock wave that propagates in a first detonation wave direction DND, as shown in FIG. 24. In the first activation mode, the asymmetric shock attenuation barrier 1180 prevents the detonation wave from the first charge 1158 from detonating the second charge 1156. More particularly, the first detonation shock wave enters the barrier 1180 through the side 1181H and travels sequentially through the face 1184A, the barrier layer 1184, the interface 1185, the barrier layer 1186, and the face 1186A, and into the second explosive charge 1156.

In this event, the shock attenuation barrier 1180 attenuates the first detonation shock wave with a first attenuation profile that prevents the first detonation wave from detonating the second charge 1156. In particular, the shock attenuation barrier 1180 attenuates the first detonation wave such that the peak pressure (which may be referred to herein as the first peak pressure) of the first detonation wave incident on the second charge 1156 is insufficient (i.e., too low) to detonate the second explosive charge 1156. The shock attenuation barrier 1180 spatially and temporally diffuses the first detonation wave to maintain the first peak pressure below a detonation threshold pressure of the second explosive charge.

Figure 29:
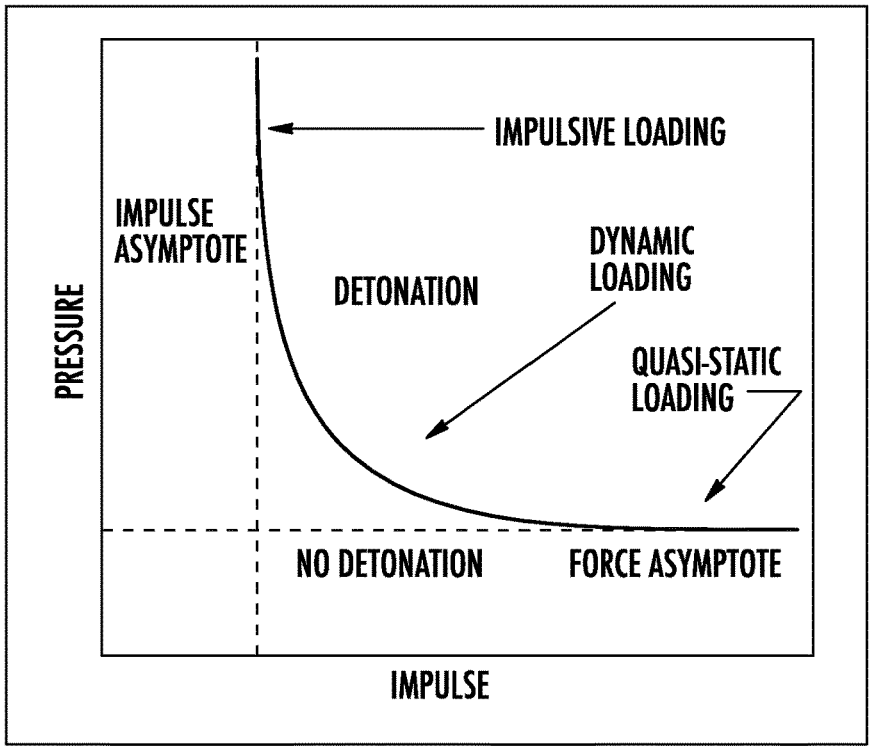
FIG. 29 is a graph schematically illustrating a relationship between shock pressure and detonation of high explosive in the munition of FIG. 24.

When the shock enters through the high-density side 1181H of the barrier 1180 there is near total reflection of the shock energy at the interface 1185 with the low-density barrier layer 1186 (assuming that the high-density barrier layer 1184 can survive the tensile wave that returns from the inner surface 1186B, as discussed below). The shock wave accelerates the high-density barrier layer 1184 in the direction DND relative to the charge 1156. This displacement of the high density barrier layer 1184 in turn displaces the inner face 1186B in the direction DND and thereby compresses the low-density barrier layer 1186 over time, distributing the shock energy both spatially and temporally. This greatly reduces the peak pressure of the shock when it enters the explosive material 1156 on the other side of the barrier 1180, as illustrated in FIG. 27. Taking advantage of the non-linear relationship between high explosive detonation and peak shock pressure (as seen in FIG. 29), this is used in the multi-functional warhead 1100 to prevent detonation. As illustrated in FIG. 28, the first detonation shock wave traverses the barrier 1180, but is not able to initiate detonation of the explosive material 1156 on the exit side of the barrier 1180.

Figure 25:
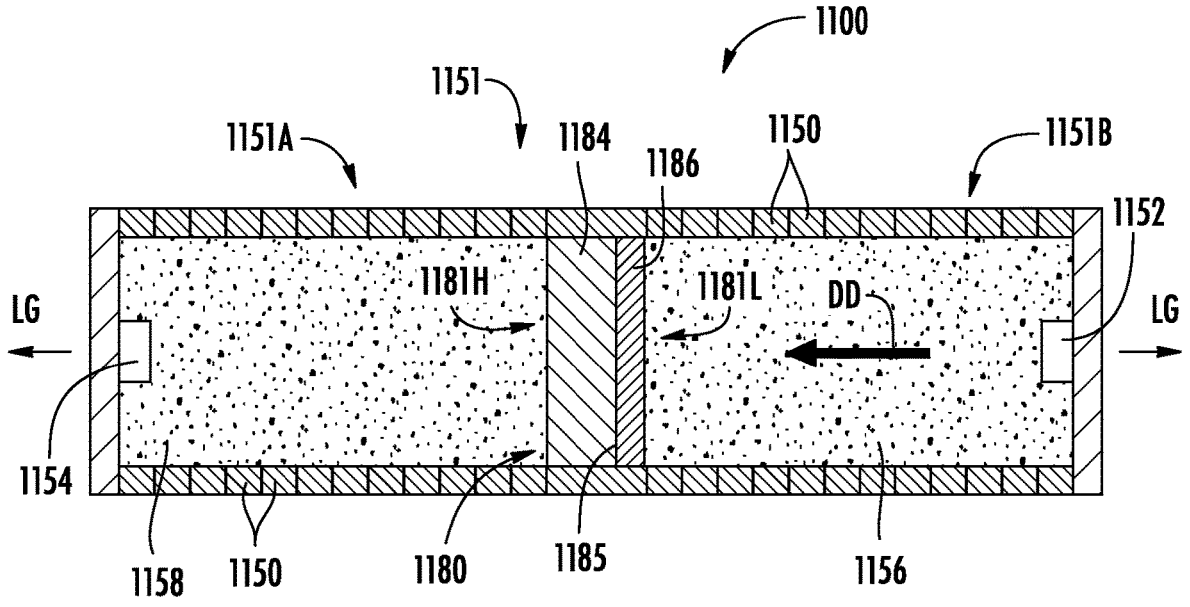
FIG. 25 is a cross-sectional view of the munition of FIG. 24, wherein activation in a second activation mode of the munition is indicated.

In the second activation mode, the second explosive charge 1156 is detonated by the detonator 1152 so that the second explosive charge 1156 in turn generates a second detonation shock wave that propagates in a second detonation wave direction DD, as shown in FIG. 25. In the second activation mode, the asymmetric shock attenuation barrier 1180 permits the detonation wave from the second charge 1156 to initiate detonation of the first charge 1158. More particularly, the second detonation shock wave enters the barrier 1180 through the side 1181L and travels sequentially through the face 1186A, the barrier layer 1186, the interface 1185, the barrier layer 1184, and the face 1184A, and into the first explosive charge 1158.

In this event, the shock attenuation barrier 1180 attenuates the second detonation shock wave with a second attenuation profile that permits the second detonation wave to detonate the first charge 1158. In particular, the shock attenuation barrier 1180 attenuates the second detonation wave such that the peak pressure (which may be referred to herein as the second peak pressure) of the second detonation wave incident on the first charge 1158 is sufficient (i.e., high enough) to detonate the first explosive charge 1158. It will be appreciated that this may occur even though the barrier 1180 does substantially reduce or delay transmission of energy from the second detonation wave to the first charge 1158.

When the shock enters through the low-density side 1181L of the barrier 1180, the low-density barrier layer 1186 the shock wave fully compacts the low-density barrier layer 1186 at the sound speed of the material of the low-density barrier layer 1186, and the shock impedance of the material of the low density barrier layer 1186 is thereby increased significantly. Increasing the shock impedance of the barrier layer 1186 reduces the impedance mismatch between the barrier layers 1184 and 1186 at the interface 1185. As a result of this reduced interface impedance mismatch, less shock energy is reflected (in the direction opposite the direction DD) at the interface 1185 and there is less diffusion of the second detonation wave energy spatially and temporally, as illustrated in FIG. 27. The peak pressure is not significantly reduced when the shock enters the explosive material 1158 on the other side of the barrier 1180. This allows detonation to continue on the exit side 1181H of the barrier 1180 in the multi-functional warhead 1100. As illustrated in FIG. 28, the second detonation shock wave traverses the barrier 1180 with sufficient energy and peak pressure that it is able to initiate detonation of the explosive material 1158 on the exit side 1181H of the barrier 1180.

Thus, the asymmetric barrier 1180 attenuates shock waves that enter through the high-density component 1184 of the barrier more effectively than it does shock waves that enter through the low-density component 1186 of the barrier.

The first detonation wave from the exploded explosive charge 1158 has a peak pressure incident on the explosive 1156 that is less than the peak pressure incident on the explosive 1158 from the detonation wave from the exploded explosive charge 1156. The first peak pressure is insufficient to detonate the explosive 1156, and the second peak pressure is sufficient to detonate the explosive 1158. The asymmetric shock attenuation barrier 1180 spatially and temporally diffuses the detonation wave from the explosive 1158 to maintain the first peak pressure below the detonation threshold of the explosive 1156.

The high-density, high-impedance barrier component 1184 reflects some shock energy (from the first detonation wave) at the interface between the face 1184A and the high explosive 1158 on the high density side 1181H. The high-density, high-impedance barrier component 1184 reflects most of the remaining shock energy (from the first detonation wave) at the interface 1185 with the low-density barrier component 1186. The barrier layer 1184 stores shock energy as kinetic energy of barrier layer 1184 and thereby significantly delays compression of the low-density barrier component 1186. The barrier layer 1184 diffuses energy from the first detonation wave over space and time. The much greater mass of the high density barrier component 1184 (as compared to the low density component) causes less momentum to be imparted from the high density barrier layer 1184 to the low density barrier layer 1186, and causes more temporal diffusion of shock energy.

Thus, when (in the first activation mode) the shock enters through the high-density side 1181H (in direction DND), compression of the low density barrier layer 1186 is delayed significantly. When (in the second activation mode) the shock enters through the low density side 1181L (in direction DND), the low-density, low-impedance barrier component 1186 is readily compressed by the second detonation wave (i.e., much more quickly than when compressed by the first detonation wave shock).

When uncompressed (or less compressed), the barrier layer 1186 has low relative shock impedance and shocks are efficiently reflected at the interface 1185 when the barrier layer 1186 is uncompressed or less compressed. When compressed (or more compressed), the barrier layer 1186 has higher relative shock impedance and shocks are not as efficiently reflected at the interface 1185. As a result, the different rates of compression of the barrier layer 1186 in response to a shock in direction DND and in response to a shock in direction DD provide substantially different amounts of shock attenuation by reflection at the interface 1185.

With appropriate material selection for the low-density, high-compressibility barrier layer 1186 (such as heterogenous polymer composites with glass microballoons, or epoxy foams), a large range of shock impedances can be obtained to vary the amount of shock energy reflected at the barrier's internal interface 1185 depending upon the direction from which the shock enters the barrier 1180.

Shock must only be attenuated in one direction (i.e., in direction DND), which reduces volume requirements of the barrier 1180 to absorb shock energy in the reduced attenuation direction. The two-layer barrier design permits the use of high-density, high-strength materials (such as steel or tungsten) for the high density barrier layer 1184, which permits thin, massive barrier designs that store more shock energy as kinetic energy while still effectively attenuating shock.

High volumetric efficiency of the barrier 1180 is enabled by the use of a high-density, high-strength barrier layer 1184 which allows significant shock energy to be stored temporarily as kinetic energy to diffuse the shock energy temporally and spatially. The high-density of the barrier component 1184 allows more energy to be stored therein with less velocity. The high-strength of the barrier component 1184 allows it to support strong tensile waves that are generated when the shock reflects off the barrier's internal interface.

Figure 30:
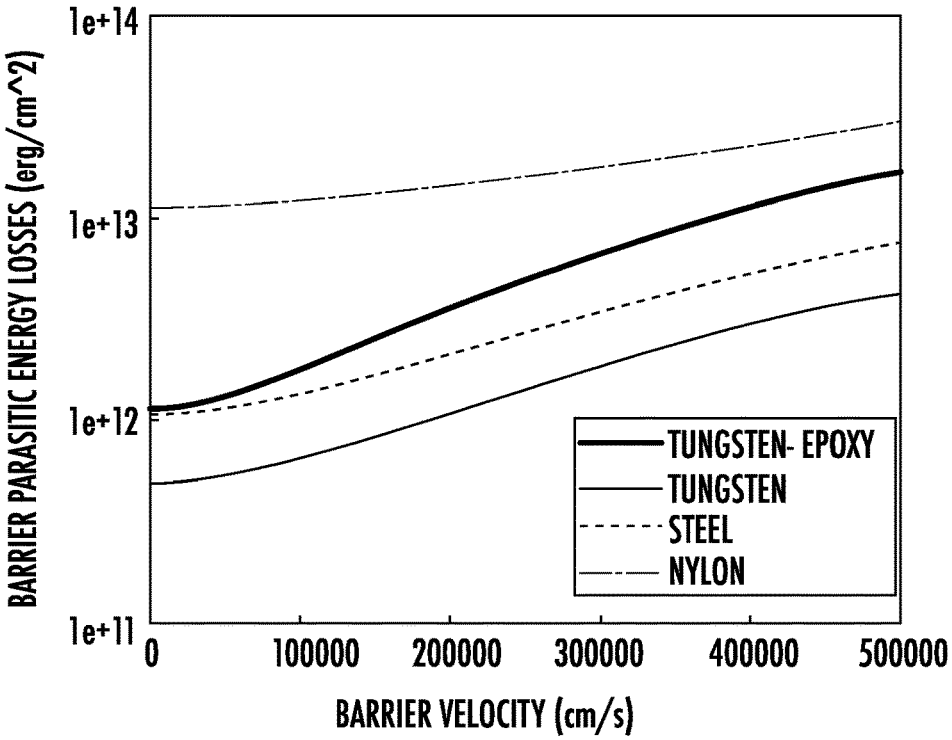
FIG. 30 is a graph schematically illustrating parasitic losses in the the munition of FIG. 24 for different shock attenuation barrier materials.

The high volumetric efficiency allows the barrier 1180 to take up less volume in the munition 1100 and thereby displace less high explosive in a munition of a given volume, thus reducing parasitic losses due to incorporation of the barrier and enabling higher munition performance. In fact, the optimal barrier design for a given application in a munition can be determined by minimizing the parasitic energy loss caused by the barrier. Parasitic losses are the sum of the chemical energy of the displaced high explosive and the expected kinetic energy of the barrier once it is accelerated after activation of the munition. These values can both be determined by determining the required volume of the barrier for a given munition configuration using various materials and layup configurations for the barrier itself. Then the parasitic losses can be plotted as a function of potential barrier velocities as seen in FIG. 30. It has been observed that the highest density barriers (in this case Tungsten) normally result in the lowest parasitic losses and therefore will enable the best munition performance.

The barrier 1180 is efficient at reflecting the shock energy using the internal interface 1185 and the interfaces between the faces 1184A, 1186A and the explosive materials 1158, 1156, but not as efficient during the initial shock interaction as might be obtained from a barrier with more shock impedance mismatched layers or a continuously graded design. It has been observed in high explosive loading environments that the pressure-impulse of the detonation wave will eventually fully compact many barriers and greatly reduce shock attenuation capabilities after a short period of time. Thus, high initial reflection of shocks is not a good indication of the barrier's performance with respect to its ability to arrest a detonation wave in a volumetrically efficient package. A barrier according to embodiments of the invention is designed to be efficient enough at reflecting shocks to prevent detonation on the opposite side of the barrier, and to retain that efficiency over a relatively extended or long period of time by storing the shock energy in the high-density layer of the barrier, which then has to travel a certain distance to compress the low-density layer of the barrier. This distributes the detonation wave over enough time and space to prevent detonation in the acceptor charge.

In some embodiments, the shock impedance of the HD barrier layer 1184 when the HD barrier layer 1184 is not loaded and is not compressed (referred to herein as "shock impedance ZFU") is at least six times the second shock impedance of the LD barrier layer 1186 when the second barrier layer is not loaded and is not compressed (referred to herein as "shock impedance ZSU").

As discussed above, the HD barrier layer 1184 has a different shock impedance when the HD barrier layer 1184 is fully loaded and compressed by the first detonation wave from the explosive 1158 (referred to herein as "shock impedance ZFC"). Likewise, the LD barrier layer 1186 has a different shock impedance when the LD barrier layer 1186 is fully loaded and compressed by the second detonation wave from the explosive 1156 (referred to herein as "shock impedance ZSC"). In some embodiments, the ratio of the shock impedance ZFC to the shock impedance ZSC is less than the ratio of the shock impedance ZFU to the shock impedance ZSU.

In some embodiments, the shock impedance ZFC is less than two times the shock impedance ZSC.

In some embodiments, the ratio of the shock impedance ZFU to the shock impedance ZSU is at least three times the ratio of the shock impedance ZFC to the shock impedance ZSC.

Barriers according to embodiments of the invention may not be mass-efficient relative to other barrier designs. However, mass-efficient designs may be less volumetrically efficient and thus increase parasitic losses and result in lower potential munition performance.

Tensile spall failure of the high density barrier layer 1184 can significantly reduce the effectiveness of barrier attenuation when shock enters through high-density barrier layer 1184. In some embodiments, the high density barrier layer 1184 is formed of a material having a high tensile spall strength and/or including sublayers (layups) of materials designed to reduce tensile stresses to prevent tensile spall failure after shock reflection at the internal interface 1185.

The high-density, high-impedance, high-strength barrier layer 1184 requires enough strength to survive the tensile loads experienced when surfaces unload after experiencing high compressive loads from high explosives. Failure due to tensile spall would result in part of the high-density barrier layer 1184 accelerating and compressing the low-density barrier layer 1186 more quickly, reducing the effectiveness of the barrier 1180. If tensile spall failure cannot be prevented, it is best to ensure failure occurs nearest the entry point of the high-density barrier layer 1184 (i.e., the outer face 1184A) to ensure the lowest velocity of the remaining mass compressing the low-density barrier layer 1186. The tensile strength required increases with explosives with higher Chapman-Jouguet pressures. For C-4 high explosive, these tensile stresses are expected to approach 20 GPa and no known available material has tensile strength this high. However, once failure occurs it redistributes and reduces the magnitude of tensile stresses elsewhere in the barrier 1180.

In some embodiments, the aforementioned tensile loads are reduced by provision and selection of appropriate layups or sublayers to form the high density barrier layer 1184. Layups or sublayers that reduce the tensile stresses or ensure failure nearest the exterior surface of the high-density barrier layer 1184 are desired.

Figure 31:
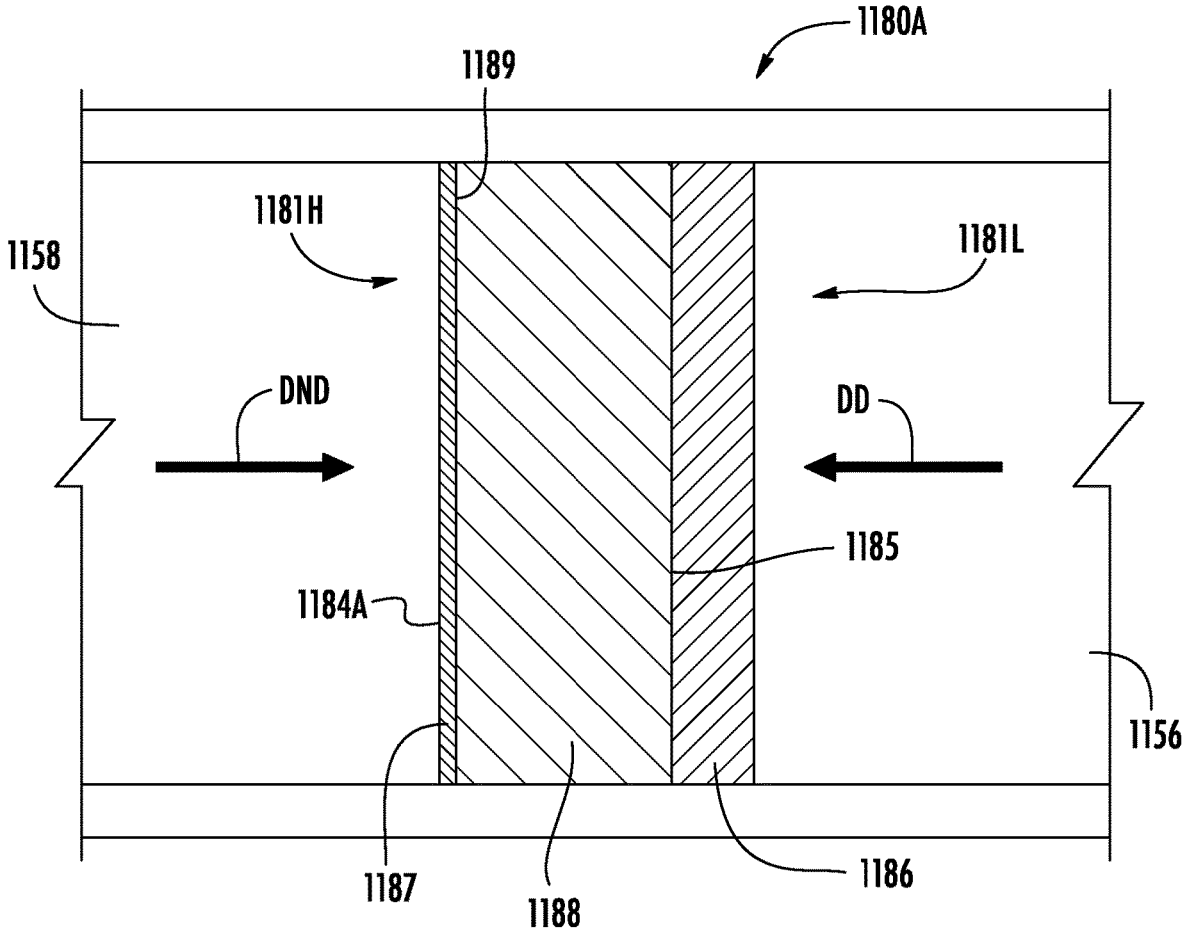
FIG. 31 is a fragmentary, cross-sectional view of the munition of FIG. 24, wherein the asymmetric shock attenuation barrier includes a high density barrier layer including multiple sublayers.

With reference to FIG. 31, an embodiment of the barrier 1180 (designated 1180A) including a multi-sublayer or layup high density barrier layer 1184 is shown therein. The barrier layer 1184 includes a first or outer sublayer 1187 on the high density entry side 1181H of the barrier 1180A, and a second or inner sublayer 1188 interposed between the outer sublayer 1187 and the low density barrier layer 1186.

The interface 1189 between the outer sublayer 1187 and the inner sublayer 1188 will reflect some shock energy and store some as kinetic energy in the outer sublayer 1187. This is sufficient to prevent tensile failure of the inner sublayer 1188 but not the outer sublayer 1187. However, since the outer sublayer 1187 is located at the exterior surface of the barrier 1180, the change in velocity of the high-density barrier layer is minimal and does not have a large effect on performance.

In some embodiments, the inner sublayer 1188 has a greater tensile spall strength than that of the outer sublayer 1187.

In some embodiments, the outer sublayer 1187 is thinner than the inner sublayer 1188.

In some embodiments, the outer sublayer 1187 is formed of tungsten and the inner sublayer 1188 is formed of steel.

The high-density, high-impedance, high-strength barrier layer 1184 may be formed of any suitable material(s). In some embodiments, the barrier layer 1184 includes a material selected from the group consisting of beryllium, aluminum, titanium, steel, molybdenum, tantalum, tungsten, and uranium. In some embodiments, the barrier layer 1184 is formed of iron alloy, molybdenum alloy, tantalum alloy, or tungsten alloy. These materials have high-density and strength, but some alloys are more suitable that others. In some embodiments, the barrier layer 1184 is formed of steel, which may include a high-yield alloy such as HY-80, HY-100, or HY-130. Typically, alloys with fine or ultra-fine grain sizes are preferred for their higher tensile spall strength. In some embodiments for high explosive applications, two or more sublayers of these materials are used in order to address the risk of tensile spall failure, as discussed above. In some embodiments for other applications with less extreme loads, a single material is used for the high-density barrier layer 1184. The single layer may be monolithic. In the multi-sublayer embodiments (e.g., barrier 1180A), each of the sublayers 1187, 1188 may be individually monolithic.

In some embodiments, the barrier layer 1184 is formed of a material having a tensile spall strength of at least 100 MPa.

The low-density, low-impedance barrier layer 1186 may be formed of any suitable material(s). The barrier layer 1186 layer should be formed of a material having a large range of shock impedance values when compressed (e.g., about $20x10^9$ Pa of applied pressure for High Explosive Applications) and uncompressed (0 Pa of applied pressure), such as in foams. In some embodiments, the barrier layer 1186 is porous. In some embodiments, the barrier layer 1186 includes gas-filled or evacuated voids. In some embodiments, the barrier layer 1186 is formed of an open cell polymeric foam, a closed cell polymeric foam, an open cell metallic foam, an open cell metallic foam, or a heterogeneous composite incorporating hollow spherical components (such as glass microballoons).

In some embodiments, the HD barrier layer 1184 is thicker than the LD barrier layer 1186. In some embodiments, the HD barrier layer 1184 has a greater mass than the LD barrier layer 1186.

In some embodiments, the outer surface 1184A of the HD barrier layer 1184 contacts the explosive 1158, and the outer surface 1186A of the LD barrier layer 1186 contacts the explosive 1156.

In some embodiments, the average density of the HD barrier layer 1184 is at least three times the average density of the LD barrier layer 1186. In some embodiments, the average density of the HD barrier layer 1184 is in the range of from about 2 g/cc to 19.3 g/cc, and the average density of the LD barrier 1186 is in the range of from about 0.05 g/cc to 0.66 g/cc.

In some embodiments, the shock impedance of the low-density, low-impedance barrier layer 1186 at room temperature and room pressure is at least an order of magnitude greater than the shock impedance of the barrier layer 1186 at a temperature of 2000 Kelvin and a pressure of $20x10^9$ Pa (approximate detonated high explosive temperature and pressure).

Shock attenuation barriers are used within the ordnance packages of multi-function munitions to fully or partially isolate HE payloads in order to facilitate different activation modes and lethal effects. However, known barriers tend to be volumetrically inefficient because highly energetic HE is displaced with inert, parasitic mass. This decreases the overall energy density of the munition and limits its effectiveness within a given mass and volume envelope. Additionally, the use of barriers to effectively segment the ordnance package reduces the effectiveness of certain activation modes to facilitate others. An example of this would be a reduction in fragmentation velocities for an area-attack activation mode when isolating components of the warhead for a focused-attack mode.

Barriers according to embodiments of the invention and as described herein (e.g., the shock attenuation barrier 1180) offer a significant improvement over existing shock attenuation barriers due to their ability to attenuate a detonation wave traveling in one direction and allow a shock or detonation wave to propagate relatively unimpeded in the opposite direction. The inventive barrier can be used as a design element when developing munitions with multiple activation modes and selectable energy outputs. In this capacity, the inventive barrier enables more flexible multifunctional ordnance packages that overcome current limitations and design constraints associated with symmetric attenuation barriers. The benefits may include more efficient utilization of existing energetic mass, reduced total parasitic mass, reduced packaging complexity, designs with fewer initiators, a greater number of potential activation modes when coupled with symmetric barriers, and asymmetric warhead effects.

Embodiments of the invention may be used in any suitable type of munition, such as missiles or bombs (e.g., smart bombs).

In some embodiments, the asymmetric shock attenuation barrier (e.g., barrier 1180) consists of only or exactly two layers, namely: a relatively high density, high shock impedance layer (e.g., barrier layer 1184); and a relatively low density, low shock impedance layer (e.g., barrier layer 1186).

The two-layer configuration of the barrier 1180 permits design optimization for use case. Performance metrics can be optimized depending upon implementation in munitions systems by selecting various high density materials for the barrier layer 1184 and sublayers 1187, 1188, by selecting various low-density materials for the barrier layer 1186, and/or by selecting thickness ratios of barrier components 1184, 1186.

As discussed above with reference to FIG. 23, in some embodiments the barrier 1080 is an asymmetric barrier. In this case, the asymmetric shock attenuation barrier 1180 can be used as the shock attenuation barrier 1080 in the warhead 1040. The shock attenuation barrier 1180 is installed with the HD side 1181H facing the core charge 1058 and the LD side 1181L facing the main charge 1056 (i.e., such that the high density barrier layer face 1184A forms the face 1082F and the low density barrier layer face 1186A forms the face 1082R of FIG. 23). In use, the shock attenuation barrier 1180 will prevent the core charge detonation wave (which enters the shock attenuation barrier 1080 in direction DC2 from the HD side 1181H) from detonating the main charge 1056, as discussed above with reference to FIG. 24. In the other hand, the shock attenuation barrier 1180 will permit the main charge detonation wave (which enters the shock attenuation barrier 1080 in direction DM2 from the LD side 1181L) to detonate the core charge 1058, as also discussed above with reference to FIG. 25.

In the above-description of various embodiments of the present disclosure, aspects of the present disclosure may be illustrated and described herein in any of a number of patentable classes or contexts including any new and useful process, machine, manufacture, or composition of matter, or any new and useful improvement thereof. Accordingly, aspects of the present disclosure may be implemented entirely hardware, entirely software (including firmware, resident software, micro-code, etc.) or combining software and hardware implementation that may all generally be referred to herein as a "circuit," "module," "component," or "system." Furthermore, aspects of the present disclosure may take the form of a computer program product comprising one or more computer readable media having computer readable program code embodied thereon.

Any combination of one or more computer readable media may be used. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages, such as MATLAB. The program code may execute entirely on the user's computer, partly on the user's computer, as a standalone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure are described herein with reference to flowchart illustrations and/or block diagrams of methods, apparatus (systems), and computer program products according to embodiments of the disclosure. It will be understood that each block of the flowchart illustrations and/or block diagrams, and combinations of blocks in the flowchart illustrations and/or block diagrams, can be implemented by computer program instructions.

These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of systems, methods, and computer program products according to various aspects of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

Many alterations and modifications may be made by those having ordinary skill in the art, given the benefit of present disclosure, without departing from the spirit and scope of the invention. Therefore, it must be understood that the illustrated embodiments have been set forth only for the purposes of example, and that it should not be taken as limiting the invention as defined by the following claims. The following claims, therefore, are to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the invention.

What is claimed:

1. A munition comprising:

a warhead having a warhead axis and axially opposed first and second warhead ends, and including:

a tubular shock attenuation barrier including an axially extending passage extending from a first barrier end proximate the first warhead end to a second barrier end proximate the second warhead end;

an explosive core charge disposed in the passage;

an explosive main charge surrounding the shock attenuation barrier;

projectiles surrounding the main charge;

a core charge detonator; and a main charge detonator;

wherein:

the warhead is configured to be activated in each of a first projection mode and an alternative second projection mode;

when the warhead is activated in the first projection mode, the main charge detonator detonates the main charge to thereby forcibly project the projectiles from the warhead with a first set of projection velocities and velocity profile;

when the warhead is activated in the second projection mode, the core charge detonator detonates the core charge proximate the first barrier end such that a core charge detonation wave propagates through the passage to the second barrier end and, at the second barrier end, the core charge detonation wave detonates the main charge to thereby forcibly project the projectiles from the warhead with a second set of projection velocities and velocity profile; and the second set of projectile velocities and velocity profile is different from the first set of projectile velocities and velocity profile; and wherein:

the passage terminates at a terminal opening at the second barrier end;

the munition includes a transition volume proximate the terminal opening;

the main charge includes a first charge section in the transition volume and a second charge section surrounding the shock attenuation barrier; and when the warhead is activated in the second projection mode, the core charge detonation wave detonates the first charge section, and a detonation wave from the first charge section thereafter detonates the second charge section.

2. The munition of claim 1 wherein, when the warhead is activated in the second projection mode, the munition forcibly projects the projectiles from the warhead with reduced velocities as compared to the first projection mode.

3. The munition of claim 1 wherein, when the warhead is activated in the second projection mode, the munition forcibly projects the projectiles with a different axial grading than when the munition projects the projectiles in the first projection mode.

4. The munition of claim 1 wherein, when the warhead is actuated in the first projection mode, a detonation wave from the main charge detonates the core charge.

5. The munition of claim 1 wherein the main charge is tubular.

6. The munition of claim 1 wherein the shock attenuation barrier and the main charge are substantially concentric.

7. The munition of claim 1 including an end member at the first barrier end, wherein:

a port is defined in the end member;

the main charge detonator includes a booster disposed in the port of the end member; and when the warhead is activated in the second projection mode, explosion product gas from the detonation of the core charge escapes from the passage through the port.

8. The munition of claim 1 wherein the shock attenuation barrier is formed of foam.

9. The munition of claim 1 wherein the projectiles are disposed in contact with the main charge.

10. The munition of claim 1 wherein the projectiles are arranged in a substantially cylindrical array.

11. The munition of claim 1 wherein the passage has a substantially uniform inner diameter from the first barrier end to the second barrier end.

12. The munition of claim 1 wherein the passage has a non-uniform inner diameter.

13. The munition of claim 1 wherein the shock attenuation barrier has a conical outer diameter.

14. The munition of claim 1 wherein the shock attenuation barrier has a tapered wall thickness.

15. The munition of claim 1 wherein the passage has a diameter in the range of from about 5% to 70% of an outer diameter of the main charge.

16. The munition of claim 1 wherein the shock attenuation barrier has a length in the range of from about 90% to 99% of a length of the main charge.

17. The munition of claim 1 wherein the munition is a missile.

18. The munition of claim 1 wherein the munition is a bomb.

19. A munition comprising:

a warhead having a warhead axis and axially opposed first and second warhead ends, and including:

a tubular shock attenuation barrier including an axially extending passage extending from a first barrier end proximate the first warhead end to a second barrier end proximate the second warhead end;

an explosive core charge disposed in the passage;

an explosive main charge surrounding the shock attenuation barrier;

projectiles surrounding the main charge;

a core charge detonator; and a main charge detonator;

wherein:

the warhead is configured to be activated in each of a first projection mode and an alternative second projection mode;

when the warhead is activated in the first projection mode, the main charge detonator detonates the main charge to thereby forcibly project the projectiles from the warhead with a first set of projection velocities and velocity profile;

when the warhead is activated in the second projection mode, the core charge detonator detonates the core charge proximate the first barrier end such that a core charge detonation wave propagates through the passage to the second barrier end and, at the second barrier end, the core charge detonation wave detonates the main charge to thereby forcibly project the projectiles from the warhead with a second set of projection velocities and velocity profile; and the second set of projectile velocities and velocity profile is different from the first set of projectile velocities and velocity profile; and wherein the shock attenuation barrier includes a plurality of transverse walls extending across and fully occluding the passage.

20. A munition comprising:

a warhead having a warhead axis and axially opposed first and second warhead ends, and including:

a tubular shock attenuation barrier including an axially extending passage extending from a first barrier end proximate the first warhead end to a second barrier end proximate the second warhead end;

an explosive core charge disposed in the passage;

an explosive main charge surrounding the shock attenuation barrier;

projectiles surrounding the main charge;

a core charge detonator; and a main charge detonator;

wherein:

the warhead is configured to be activated in each of a first projection mode and an alternative second projection mode;

when the warhead is activated in the first projection mode, the main charge detonator detonates the main charge to thereby forcibly project the projectiles from the warhead with a first set of projection velocities and velocity profile;

when the warhead is activated in the second projection mode, the core charge detonator detonates the core charge proximate the first barrier end such that a core charge detonation wave propagates through the passage to the second barrier end and, at the second barrier end, the core charge detonation wave detonates the main charge to thereby forcibly project the projectiles from the warhead with a second set of projection velocities and velocity profile; and the second set of projectile velocities and velocity profile is different from the first set of projectile velocities and velocity profile; and wherein the shock attenuation barrier includes a plurality of flanges projecting radially into and constricting the passage.

21. A method for operating a munition, the method comprising:

providing a munition including:

a warhead having a warhead axis and axially opposed first and second warhead ends, and including:

a tubular shock attenuation barrier including an axially extending passage extending from a first barrier end proximate the first warhead end to a second barrier end proximate the second warhead end;

an explosive core charge disposed in the passage;

an explosive main charge surrounding the shock attenuation barrier;

projectiles surrounding the main charge;

a core charge detonator; and a main charge detonator;

wherein the warhead is configured to be activated in each of a first projection mode and an alternative second projection mode; and activating the warhead in either the first projection mode or the second projection mode;

wherein:

when the warhead is activated in the first projection mode, the main charge detonator detonates the main charge to thereby forcibly project the projectiles from the warhead with a first set of projection velocities and velocity profile;

when the warhead is activated in the second projection mode, the core charge detonator detonates the core charge proximate the first barrier end such that a core charge detonation wave propagates through the passage to the second barrier end and, at the second barrier end, the core charge detonation wave detonates the main charge to thereby forcibly project the projectiles from the warhead with a second set of projection velocities and velocity profile; and the second set of projectile velocities and velocity profile is different from the first set of projectile velocities and velocity profile; and wherein:

the passage terminates at a terminal opening at the second barrier end;

the munition includes a transition volume proximate the terminal opening;

the main charge includes a first charge section in the transition volume and a second charge section surrounding the shock attenuation barrier; and when the warhead is activated in the second projection mode, the core charge detonation wave detonates the first charge section, and a detonation wave from the first charge section thereafter detonates the second charge section.

* * * * *